US008495846B2

(12) United States Patent
Bravinski

(10) Patent No.: US 8,495,846 B2
(45) Date of Patent: Jul. 30, 2013

(54) FORMWORK ASSEMBLY FOR FABRICATING COMPOSITE STRUCTURES INCLUDING FLOOR AND ROOF STRUCTURES

(76) Inventor: Leonid G. Bravinski, Toronto (CA)

( * ) Notice: Subject to any disclaimer, the term of this patent is extended or adjusted under 35 U.S.C. 154(b) by 1010 days.

(21) Appl. No.: 10/629,746

(22) Filed: Jul. 30, 2003

(65) Prior Publication Data

US 2005/0034418 A1 Feb. 17, 2005

(51) Int. Cl.
*E04B 5/29* (2006.01)
*E04B 5/04* (2006.01)

(52) U.S. Cl.
USPC ..... 52/326; 52/334; 52/340; 52/414

(58) Field of Classification Search
USPC ..... 52/320, 321, 322, 326, 334, 338, 52/340, 414; 249/19, 23, 28, 30
See application file for complete search history.

(56) References Cited

U.S. PATENT DOCUMENTS

| | | | | | |
|---|---|---|---|---|---|
| 809,090 | A | * | 1/1906 | Cainee | 52/326 |
| 1,688,723 | A | * | 10/1928 | Lathrop | 52/338 |
| 1,819,906 | A | * | 8/1931 | Marks | 249/24 |
| 1,864,025 | A | * | 6/1932 | Martin | 52/338 |
| 2,844,024 | A | * | 7/1958 | McDonald | 52/326 |
| 2,969,619 | A | | 1/1961 | Didrick | |
| 3,113,402 | A | * | 12/1963 | Butler | 52/326 |
| 3,289,371 | A | * | 12/1966 | Pearson et al. | 52/338 |
| 3,307,304 | A | * | 3/1967 | Klausner | 52/326 |
| 3,382,637 | A | * | 5/1968 | Longinotti | 52/320 |
| 3,543,458 | A | * | 12/1970 | Guritz | 52/127.3 |
| 3,792,560 | A | | 2/1974 | Naylor | |
| 3,930,348 | A | | 1/1976 | Wise | |
| 3,953,954 | A | | 5/1976 | Leone | |
| 3,965,641 | A | * | 6/1976 | Carroll | 52/338 |
| 3,979,868 | A | | 9/1976 | Butts et al. | |
| 4,037,375 | A | | 7/1977 | Maggos et al. | |
| 4,145,861 | A | | 3/1979 | Yarnick | |
| 4,223,487 | A | * | 9/1980 | St. Clair | 52/309.8 |
| 4,227,356 | A | * | 10/1980 | Stern et al. | 428/308.8 |
| 4,241,555 | A | | 12/1980 | Dickens et al. | |
| 4,602,467 | A | | 7/1986 | Schilger | |
| 4,619,096 | A | | 10/1986 | Lancelot, III | |
| 4,653,237 | A | | 3/1987 | Taft | |
| 4,885,884 | A | * | 12/1989 | Schilger | 52/354 |
| 4,930,278 | A | * | 6/1990 | Staresina et al. | 52/414 |

(Continued)

*Primary Examiner* — Michael Safavi

(57) ABSTRACT

A system for fabricating a slab from a construction material having both unhardened and hardened states includes a form panel unit and a pair of spaced structural supporting members. The supporting members are adapted for assisting in supporting said slab made the construction material. The form panel unit includes a panel member adapted for use as part of a form to retain said construction material when in an unhardened state and has generally opposed upper and lower surfaces. The panel unit also has at least one reinforcement unit having at least one reinforcement member mounted above the upper surface of the panel member is interconnected to the panel member. The form panel unit is configured so that the panel member can be positioned between the supporting members, such that said unhardened construction material can be retained above the upper surface of the panel member to permit hardening of said construction material from its unhardened state to its hardened state. The reinforcement member has a portion mounted on at least one of the supporting members so that the panel member is at least in part suspended from at least one supporting member, and wherein the supporting member has an upper portion extending above the upper surface of said panel member so as to be embedded in the construction material.

56 Claims, 21 Drawing Sheets

U.S. PATENT DOCUMENTS

| | | | | |
|---|---|---|---|---|
| 4,953,334 | A | | 9/1990 | Dickens |
| 5,414,972 | A | | 5/1995 | Ruiz et al. |
| 5,448,866 | A | | 9/1995 | Saito et al. |
| 5,544,464 | A | | 8/1996 | Dutil |
| 5,612,111 | A | * | 3/1997 | Lin ..... 52/309.9 |
| 5,664,378 | A | | 9/1997 | Bettigole et al. |
| 5,809,724 | A | * | 9/1998 | Bodnar ..... 52/414 |
| 5,809,725 | A | | 9/1998 | Cretti |
| 5,845,445 | A | | 12/1998 | Blackbeard |
| 5,881,524 | A | | 3/1999 | Ellison, Jr. |
| 5,893,248 | A | | 4/1999 | Beliveau |
| 5,934,036 | A | | 8/1999 | Gallagher, Jr. |
| 6,006,483 | A | | 12/1999 | Lee |
| 6,122,888 | A | | 9/2000 | Bodnar |
| 6,151,858 | A | | 11/2000 | Ruiz et al. |
| 6,161,352 | A | | 12/2000 | Frohlich |
| 6,244,008 | B1 | | 6/2001 | Miller |
| 6,272,749 | B1 | | 8/2001 | Boeshart et al. |
| 6,279,281 | B1 | | 8/2001 | Lee |
| 6,298,622 | B1 | | 10/2001 | Cretti |
| 6,314,694 | B1 | | 11/2001 | Cooper et al. |
| 6,357,191 | B1 | | 3/2002 | Ault et al. |
| 6,370,831 | B1 | | 4/2002 | Marshall et al. |
| 6,401,417 | B1 | | 6/2002 | Leblang |
| 6,442,910 | B1 | | 9/2002 | Ellison, Jr. |
| 6,457,288 | B2 | | 10/2002 | Zambelli et al. |
| 6,484,464 | B1 | | 11/2002 | Ochoa |
| 6,526,713 | B2 | | 3/2003 | Moore, Jr. |
| 6,550,195 | B1 | | 4/2003 | Cooper et al. |
| 2001/0039773 | A1 | | 11/2001 | Bot |
| 2006/0124825 | A1 | | 6/2006 | Amend |
| 2007/0074804 | A1 | | 4/2007 | Amend |
| 2007/0095010 | A1 | | 5/2007 | Amend |

* cited by examiner

FORMWORK ASSEMBLY FOR FABRICATING COMPOSITE STRUCTURES INCLUDING FLOOR AND ROOF STRUCTURES

TECHNICAL FIELD

The present invention relates to methods and systems for fabricating composite structures, including floor and roof structures.

BACKGROUND OF THE INVENTION

It is known to use reinforced concrete to build various structures. Reinforced concrete is used for example in pre-fabricated and monolithic slabs for floor and roof structures. Ribbed reinforced concrete floor and roof structures are the most structurally effective. However, the known methods of construction of floor and roof slab, particularly pre-fabricated ribbed structures are relatively complex. Accordingly the costs are relatively high due to the relatively high costs for making such slabs, and the expensive delivery and crane involvement needed for the unloading and installation at the construction site. Erection of the monolithic ribbed reinforced concrete floor system with stay-in-place or removable formwork is also very expensive due to high labor costs for the formwork construction and shoring (vertical propping) and if removable formwork, its disassembly afterwards.

To avoid these disadvantages, the ribbed reinforced concrete floor systems are more often used for the monolithic structures with additional elements to form composite structures. Another fabricated element, such as a truss, a girder or steel or aluminum beam is used to provide the designed structural stability and strength to handle the loads during the erection of the reinforced concrete floor and roof structures. These beams are anchored in the reinforced concrete floor integrating them into the ribbed floor system to serve as ribs, but require special devices to provide appropriate anchoring in the standard beams.

For such reinforced concrete floor system, it is known to utilize a stay-in-place formwork from the rigid foam plastic materials, in particular, foamed polystyrene. Thus, such reinforced concrete floor system provides the compliance with the other design requirements, such as thermal and acoustic insulation properties. However, due to insufficient strength of the foamed polystyrene, this stay-in-place formwork requires the construction of supporting structures and their disassembly after unhardened concrete pouring and concrete hardening, which is a highly time-consuming procedure.

Also, known reinforced concrete composite floor structures require the installation of longitudinal and transverse reinforcement bars and their proper positioning in the slab, which is a highly time-consuming and requires skilled laborers and engineer's supervision during installation of the reinforcement prior to the concrete being poured. This increases the overall cost of the construction.

Therefore, the known systems and methods are relatively inefficient, expensive and therefore it is desired to provide improved methods and systems.

SUMMARY OF THE INVENTION

According to one aspect of the present invention, there is provided a system for fabricating a slab from a construction material having both unhardened and hardened states. The system is comprised of a form panel unit and a pair of spaced structural supporting members adapted for assisting in supporting the slab made with the construction material. The form panel unit is comprised of a panel member, which generally has opposed upper and lower surfaces, adapted for use as part of a form to retain the construction material when in an unhardened state and at least one reinforcement unit which has at least one reinforcement member mounted above the upper surface of the panel member and is interconnected to the panel member. The form panel unit is configured such that the panel member can be positioned between the spaced structural supporting members, such that the unhardened construction material can be retained above upper surface of the panel member to permit hardening of the construction material from the unhardened state to the hardened state. The reinforcement member has a portion being mounted on at least one of the supporting members such that the panel member is at least in part suspended from the at least one supporting member, and wherein the at least one supporting member has an upper portion extending above the upper surface of the panel member so it can be embedded in the construction material.

According to another aspect of the present invention, there is provided a system for fabricating a slab from a construction material having both hardened and hardened states. The system is comprised of first and second form panel units and first, second and third spaced structural supporting members adapted for assisting in supporting the slab made from the construction material. Each of the first and second form panel units is comprised of a panel member, which has generally opposed upper and lower surfaces, adapted for use as part of a form to retain the construction material when in an unhardened state and at least one reinforcement unit each having at least one reinforcement member mounted above the upper surface of the panel member. The first form panel unit is configured such that the panel member of the first form panel unit is positioned between the first and second spaced structural supporting members. The reinforcement member of the reinforcement unit of the first form panel unit is supported at least in part by the first and second supporting members such that the panel member of the first form panel unit is suspended from the first and second supporting members on the reinforcement member above the upper surface. The second form panel unit is configured such that the panel member of the second form panel unit can be positioned between the second and third spaced structural supporting members. The reinforcement member is supported at least in part by the second and third supporting members such that the panel member of the second form panel unit is suspended from the second and third supporting members on the reinforcement member of the second reinforcement unit above the upper surface of the panel member of the second form panel unit. Wherein the unhardened construction material can be retained above the panel members of the first and second form panel units between the first and third structural supporting members to permit hardening from the unhardened state to the hardened state of the construction material.

According to another aspect of the present invention, there is provided a structural slab comprised a construction material; a form panel unit; and, first and second spaced structural supporting members adapted to assist in supporting the slab made from the construction material. The form panel unit is comprised of a panel member which has an upper surface and forms at least part of a form. At least one reinforcement unit has at least one reinforcement member mounted to the panel member above the upper surface of the panel member. The panel member is suspended from the first and second supporting members on the reinforcement member. The construction material envelops at least an upper portion of the supporting members and the reinforcement member.

According to another aspect of the invention, there is provided a method for fabricating a slab from a construction material having both hardened and unhardened states using a formwork system. The formwork system is comprised of a form panel unit and first and second structural members adapted to assist in supporting the slab made from the construction material. The form panel unit is comprised of a panel member, which generally has opposed upper and lower surfaces, adapted for use as a form to retain the construction material in an unhardened state and at least one reinforcement unit each having at least one reinforcement member mounted to the panel member above the upper surface. The method comprises the steps of (i) arranging the first and second structural support members in a spaced relation suitable for supporting the panel member; and, (ii) positioning the reinforcement unit such that the panel member is suspended from the first and second spaced structural supporting members, such that the unhardened construction material can be retained above the panel member to permit hardening from the unhardened state to the hardened state of the construction material, and such that the reinforcement member is supported at least in part by the supporting members and the panel member is suspended from the supporting members on the reinforcement member above the upper surface.

According to another aspect of the present invention, there is provided a system for fabricating a slab from a construction material having both unhardened and hardened states. The system comprises a form panel unit and a pair of spaced structural supporting members adapted for supporting the slab made from the construction material. The form panel unit is comprised of first and second panel members, each adapted for use as a form to retain the construction material when in a unhardened state. Each first and second panel members have generally opposed inner and outer surfaces, and opposed first and second side surfaces. The first and second panel members are arranged in spaced, generally aligned relation with the inner surface of the first panel arranged in face to face relation with the inner surface of the second panel. At least one reinforcement unit has at least one reinforcement member mounted to both of the first and second panel member between the inner surfaces of the first and second panels, the reinforcement member extending beyond at least one of the first and second side surfaces of the first panel member. The form panel unit is configured such that the first panel member can be positioned between the spaced structural supporting members, such that the liquid construction material can be retained between the first and second panel members, between the structural supporting members to permit hardening from the liquid state to the hardened state of the construction material. The reinforcement member is supported at least in part by the supporting members such that the first panel member is suspended from the supporting members on the reinforcement member.

According to another aspect of the invention, there is provided a method for fabricating a slab from a construction material having both hardened and unhardened states using a formwork system. The formwork system is comprised of a form panel unit and first and second supporting members adapted to assist in supporting the slab made from the construction material. The form panel unit is comprised of a panel member, which generally has opposed upper and lower surfaces and opposed first and second side surfaces, adapted for use as a form to retain said construction material when in a liquid state and at least one reinforcement unit each having at least one reinforcement member mounted to the panel member above the upper surface. The method comprises the steps of: (1) arranging the first and second structural support members in a spaced relation suitable for receiving the panel member therebetween; and, (2) suspending the panel member between the pair of supporting members on the reinforcement member, such that the panel member is located between the first and second spaced structural supporting members and the unhardened construction material can be retained above the panel member.

According to another aspect of the present invention, there is provided a formwork assembly for fabricating a slab from a construction material having both unhardened and hardened states. The formwork assembly is comprised a form panel unit and a pair of supporting members adapted for assisting in supporting the slab made from the construction material. The form panel unit is comprised of a panel member having generally opposed upper and lower surfaces and a pair of supporting members adapted for assisting in supporting the slab made from the construction material. The panel member is adapted to be used as part of a form to retain the construction material above the upper surface when in an unhardened state. A reinforcement unit having at least one reinforcement member mounted above the upper surface of the panel member. The panel member is suspended between the pair of supporting members on the reinforcement member, such that the unhardened construction material can be retained above the panel member.

According to another aspect of the present invention, there is provided a structural elongated support member for use in supporting a concrete slab. The support member has an upstanding web which has an upper elongated web portion. The upper web portion has a plurality of spaced apertures disposed along the elongated upper web portion.

BRIEF DESCRIPTION OF THE DRAWINGS

In drawings that illustrate by way of example only, preferred embodiments of the present invention.

Figures 1, 1A:
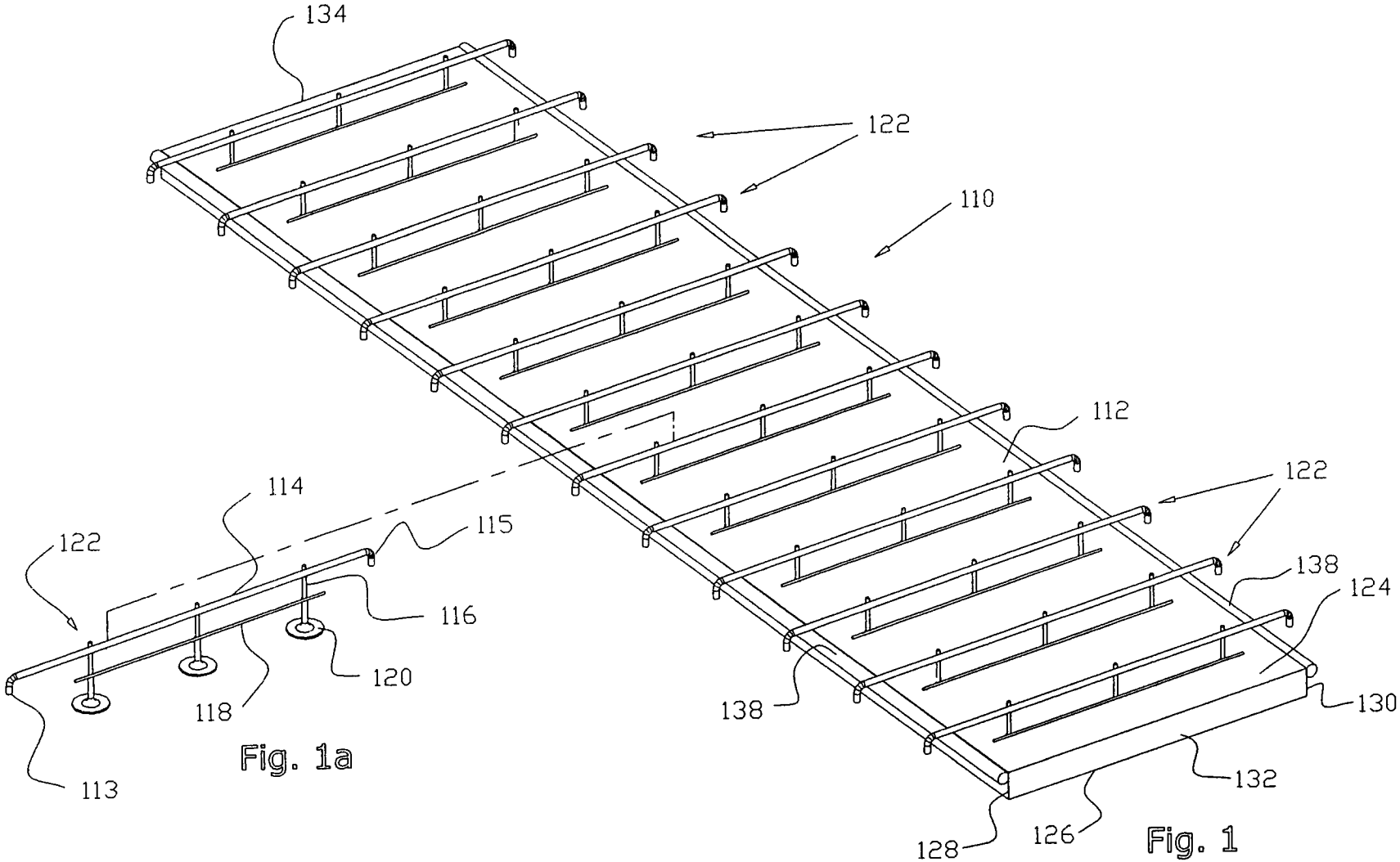
FIG. 1 is a top perspective view of a form panel unit in accordance with an embodiment of the invention.
FIG. 1*a* is a top perspective view of one of the several reinforcement units that are part of the form panel unit of FIG. 1.
Figure 1B:
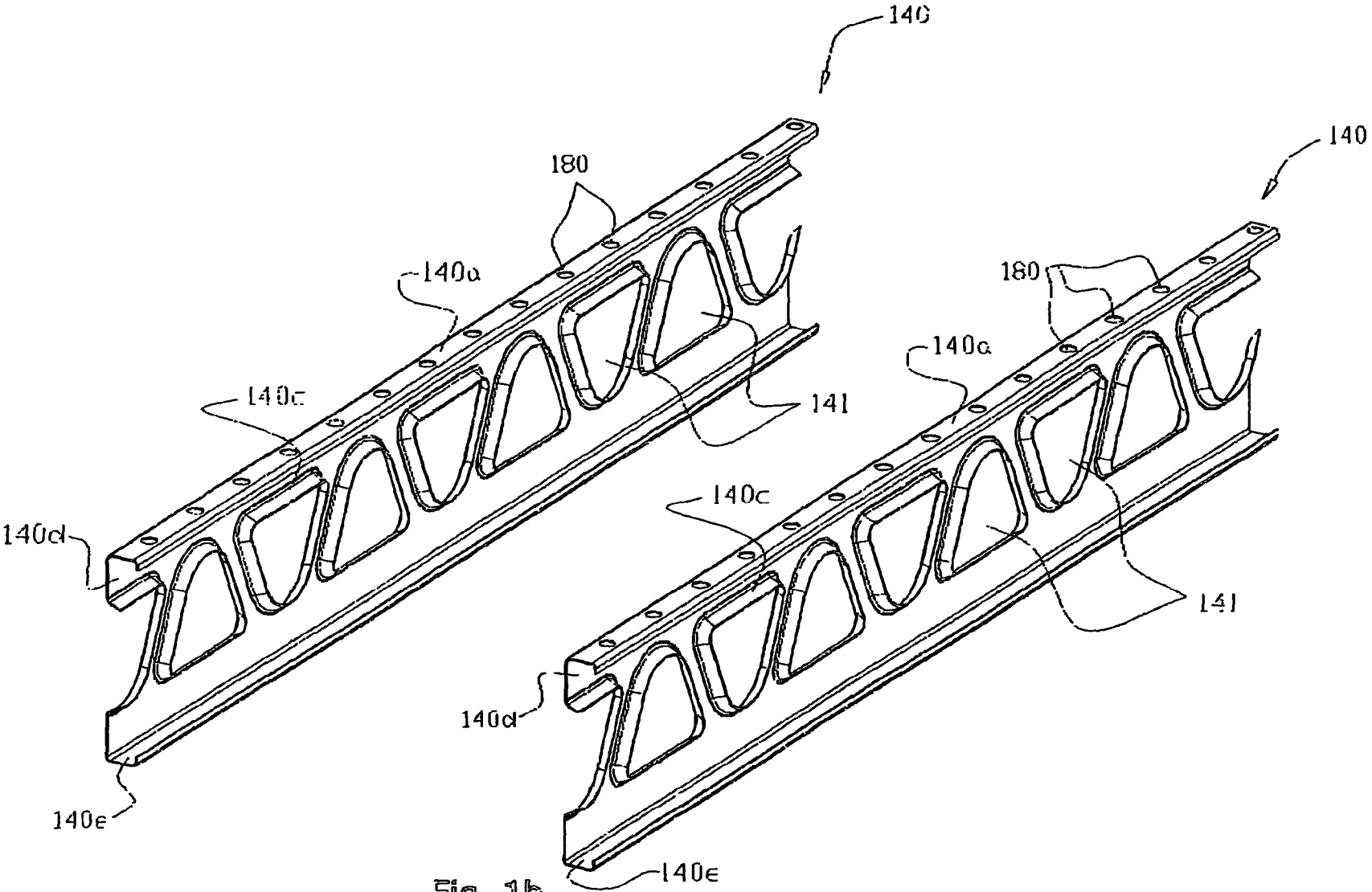
FIG. 1*b* is a top perspective of a pair of supporting beam members.

Thus, each reinforcement units 122 may thus each have a first portion (such as connector 120) rigidly interconnected to a second portion (such as reinforcement bar 114) by a third portion (such as vertical rod 116). Reinforcement units also have a fourth portion (such as rod 118).

DETAILED DESCRIPTION

With reference to FIGS. 1 and 1*a*, a form panel unit 110 is illustrated and includes a perforated panel 112, which may in some embodiments be generally parallelepiped in shape. Panel 112 may be made from a foamed plastic, such as polystyrene, type XPS or EPS having a density for example, of 1.2 to 2.0 pounds/feet$^3$: Such polystyrene foam panels 112 are commercially available and often come in sizes as 2'×8' or 4'×8' and thickness of 2", 3" or 4". Although foam plastic panels are preferred, other type of materials can be used for the panels such as particle boards, oriented strength boards (OSB), plywood, cement-bonded particle boards and etc.

In some embodiments, panels 110, such as EPS panels, can be laminated with a polyethylene or polypropylene skin during manufacturing in order to decrease the thickness of the panels. Providing such a skin, laminated to both the upper surface 124, and lower surface 126 provides the panel with greater flexural strength, than an unlaminated panel. By way of example, while an unlaminated panel of EPS would preferably by way of example, be about 100 mm thick for an application, the laminated panel can be in the order of 50 mm and still have the necessary performance characteristics. It should be noted that with XPS panels there is typically no need to laminate the same on either upper or lower surfaces. Foam plastic panel 112 has a generally planar upper surface 124 and lower surface 126. Additionally, it has side surfaces 128 and 130 as well as opposed front and rear surfaces 132 and 134, all of which are planar and are oriented generally orthogonal to their respective adjacent surfaces.

With reference to FIGS. 1, 1*a*, 2 and 2*a*, it will be observed that form panel units 110 also include a plurality of transversely spaced reinforcement units 122. Reinforcement units 122 include horizontal reinforcement bar members 114, orthogonally positioned rod members 116 and a spacer rod member 118. Members 114, 116 and 118 are all welded or otherwise secured together as a composite structure to provide for a rigid structure. Preferably rod 118 and reinforcement bar 114 are substantially parallel to each other and vertical rod 116 is orthogonal to both rod 118 and reinforcement bar 114. Spot welding may be carried out to join the members together at all locations where the members cross each other. The panels may be perforated with appropriately spaced apertures prior to installation in the formwork to permit the vertical rods 116 to pass through the panels. It should be recognized, however, that a seal of some kind should be provided (such as by a tight friction fit) to inhibit leakage of unhardened composite material. Perforations can be provided using conventional techniques and devices or with a device like or similar to that which is disclosed in U.S. patent application Ser. No. 10/253,843 filed Sep. 24, 2003, and Ser. No. 10/307,855 filed Dec. 2, 2002, the contents of which are hereby incorporated herein by reference.

Reinforcement bars 114 have hooked end portions 113 and 115 at either end which facilitates the positioning and securing of the form panel unit 110 when the reinforcement bars 114 are supported by/suspended on the upper face of the transverse flange portion 140*a* of beam members 140. Reinforcement bars 114 and the portions thereof that are supported on beam members 140 are positioned proximate to upper surface 124 of panel member 112 and are closer to upper surface 124 than to lower surface 126 of panel member 112.

At the lower end of rod 116, a connector member 120 is provided which can engage and be secured to the downwardly extending end portion 116*a* of rod 116. Connectors can be made from a suitable plastic material such as polypropylene or polyvinyl chloride. Connectors 120 have a shaft portion 120*a*, which includes a cylindrical cavity having an end opening which can engage a rod end portion 116*a* of rod 116. The cylindrical cavity will typically have a thread for engaging the end 116*a* of the rod. The end 116*a* may also have a tap end to form a threaded connection to the connector 120. The connector 120 can be drawn further along rod portion 116*a* thus tightening the connection between connector 120, panel 112 and spacer rod 118. The extension portion 120*a* will eventually engage spacer rod 118 thus preventing over tightening of the connector, which might damage the foam plastic panel 112. However, it is desirable that panel 112 be firmly held, possibly under slight compression, between the spacer bars 118 and their respective connectors 120 of each of the reinforcement units 122. Additionally, the spacer rod 118 ensures proper spacing of reinforcement bar members 114 from the inner surface of the panel 112 providing the required concrete protective layer, which is important in building concrete reinforced structures.

As shown in FIG. 1, reinforcement units 122 are longitudinally spaced from each other along the length of panel 112 and this spacing can be approximately 8 inches for many applications, although the spacing can be selected to suit each application.

Vertical rods 116 can be by way of example, ¼ inch cross sectional diameter/width steel rods and transverse reinforcement bars 114 can be steel rods. Reinforcement bars 114 may typically have a ribbed surface, and can by way of example have cross sectional diameters or cross sectional widths of 8 mm to 15 mm, although other configurations and materials, of course, are possible. Spacer bar 118 can be a steel rod having a diameter or width in the range of 2 mm to 4 mm.

Finally, form panel unit 110 includes a longitudinally extending sealing members 138 which are mounted by conventional means such as with construction adhesives to side surfaces 128 and 130 near the upper surface 124 of panels 112. Sealing members 138 should extend the length of foam panel 112 and be of a suitable resilient sealer material, such as for example, an expanded rubber, sponge or other resilient materials commonly used for window and door sealing. Such resilient sealing members 138 can have a cross-sectional diameter or width in the range of ¼ inch to 1½ inches. Alternatively other sealing members or mechanisms can be employed.

It will be appreciated that in this embodiment (like the other embodiments described hereafter) stretching longitudinally, a series of reinforcement units 122 including panels 112 can be mounted on and between each pair of beams 140 to provide for a longitudinally extending formwork of a series of panels. Transverse panels edge faces that are adjacent each other in panels arranged in a longitudinal direction, can be held in abutment with each other to provide a suitable seal. Also, seals in the transverse direction, between such adjacent longitudinal panels can be provided, such as with construction expandable foam.

It will also be appreciated that although not shown in the drawings conventional form techniques and materials can be used at the extreme side faces (both transverse and longitudinal) of the composite formwork provided by a series of panel units 110 arranged both longitudinally and transversely adjacent each other to restrain the unhardened composite material from flowing horizontally, thus providing the slab with an appropriate depth of composite material.

Figure 2:
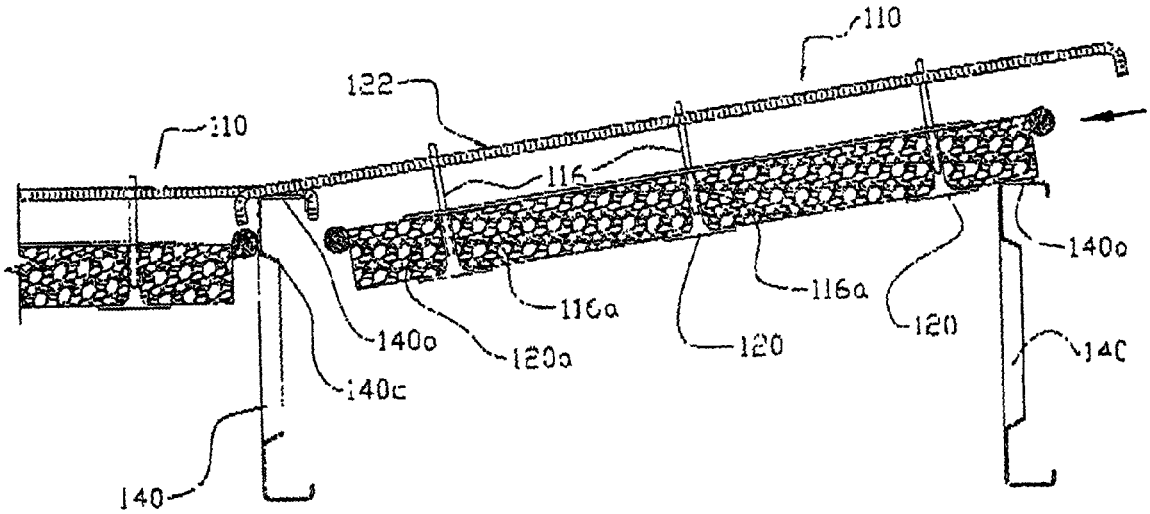
FIGS. 2 and 2*a* are fragmented transverse cross sectional views showing the mounting of a form panel unit of FIG. 1 onto the supporting beam members of FIG. 1*b* which have an opening therebetween.
Figure 2A:
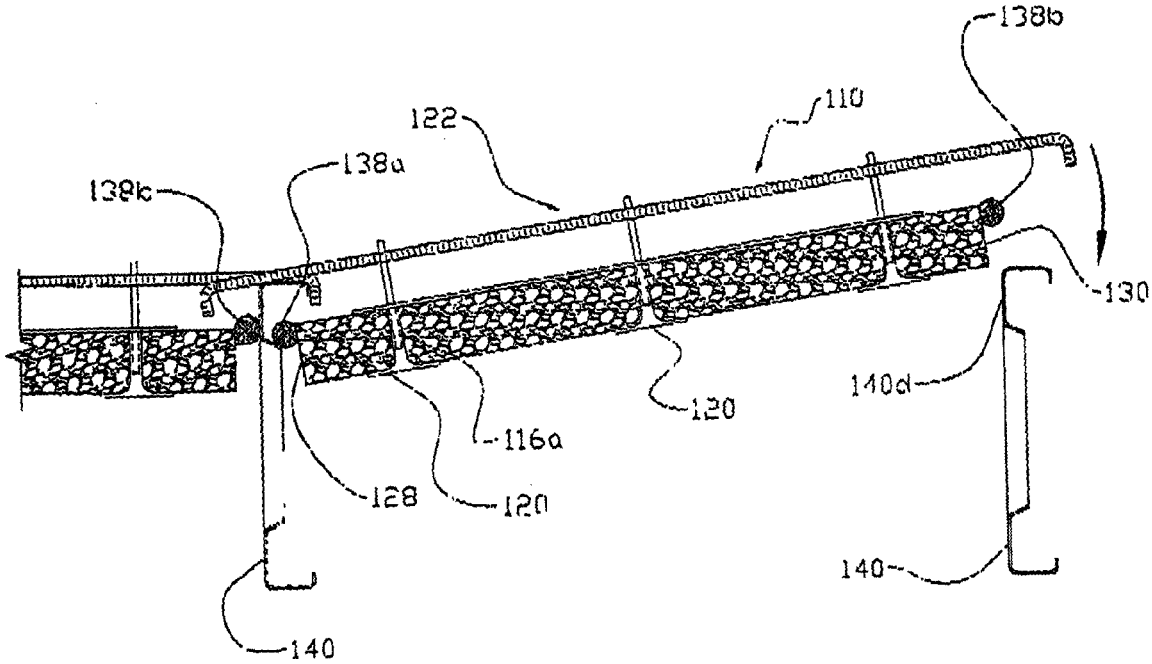

With particular reference now to FIGS. 2 and 2*a*, form panel units 110 are illustrated. A form panel unit 110 can be mounted between spaced support members 140. Support members 140 can themselves connected to or otherwise supported other members of structures (not shown) such as by a structural wall, foundation wall, posts or other members or structures. In the example illustrated embodiment, and as shown in isolation in FIG. 1*d*, support members 140 are steel beams having a generally channel shaped form and have relatively large transversely extending apertures 141 through the vertical web portions. Apertures 141 facilitate a lightening of the weight of the steel beam, as well as to provide for passage therethrough of duct pipes, wiring or the like, have a series of spaced apertures. An example of a suitable beam member would be the Thermasteel™ beam manufactured by company Vicwest (Oakville, Ontario, www.vicwest.com). It should be noted, that steel and wooden flange beams, composite wooden I-beams, steel and wooden girders, etc. can be used as support members.

The standard beam members 140 are however modified to provide vertically extending apertures 180 that pass through the upper web portion 140*a* of each beam 140. Apertures 180 serve two principal functions (1) during the concrete pouring process, they inhibit the development of air pockets underneath web portion 140*a* of beams 140 (air pockets are undesirable in concrete) and (2) they assist in the anchoring of the beam member in the concrete slab once the concrete has hardened. The size and spacing of the apertures 180 is selected such that the strength of the beam is not impaired to the extent it can't fulfill its supporting function. By way of example only circular apertures having a diameter of about 15-25 mm on a web portion 140*a* 50 mm in width, spaced apart at intervals of 80-120 mm are acceptable for most applications where the length of the member does not exceed 12 m.

As shown in FIGS. 2 and 2*a*, form panel units 110 can be mounted between beam members 140 by hooking end portions 115 of each of the members 114 along one side of the reinforcement units over the opposite side of the top surface of the web portion 140*a* of the longitudinally extending beam members 140. Then the form panel unit 110 is moved generally horizontally such that the sealing member 138 comes into contact with and rests against a surface of an upper portion 140*d* of the vertical web, above and supported on upward facing flange portions 140*c* surrounding apertures 141 of beam member 140.

As shown in FIG. 2*a*, the other side of form panel unit 110 can thereafter be pivoted downward and the other sealing member 138*b* will be compressed along with sealing member 138*a*, such that a tight sealing fit formed between the edge surfaces 128, 130 and the adjacent surfaces of the portions 140*d* of beams 140. Thus panel units 110 can be easily mounted on a series of spaced, longitudinally extending beam members 140.

Figure 2B:
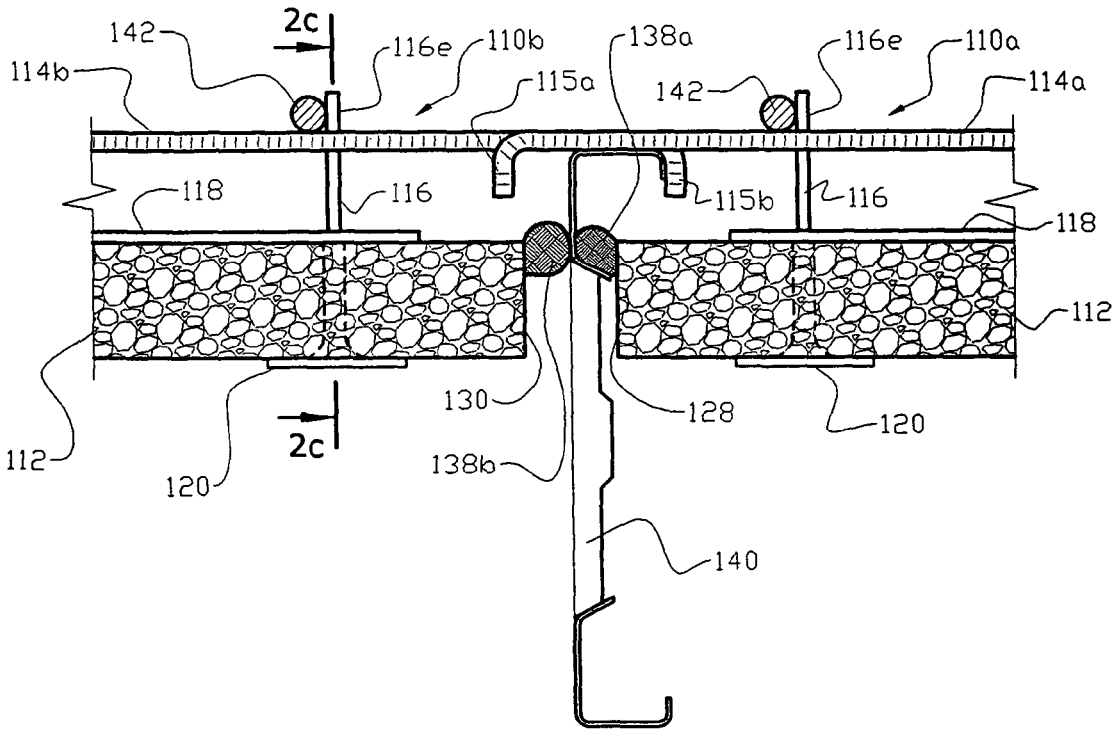
FIG. 2*b* is an enlarged detailed fragmented transverse cross-sectional view of the connection between two adjacent form panel units of FIGS. 2 and 2*a*, each supported at one end by a common supporting beam member.

As illustrated in FIG. 2*b*, a connection between adjacent form units 110*a* and 110*b* is shown whereby reinforcement member 114*a* overlaps with reinforcement member 114*b* of form panel unit 10*b*. Also, as illustrated in FIG. 2*b*, sealing elements 138*b* have been compressed between the edge surfaces 128, 130 and the adjacent surfaces of the beam member 140. In this way, seals are provided between the longitudinal edges of the form panels and the beam 140. It should be noted that at the longitudinal, transverse extending end surfaces 132 and 134 (see FIG. 1), suitable seals may be required to ensure a seal that will prevent the flow of unhardened concrete between longitudinally arranged, adjacent panels, when the concrete is poured into the form. The sides of the slab formwork can be provided by conventional techniques and materials (not shown).

Upward extensions 116*e* of the rod members 116 cooperate with reinforcement bar members 114*a* and 114*b* to provide location positions for longitudinal reinforcement bar members 142, which may be conventional reinforcement steel bars.

Figure 2C:
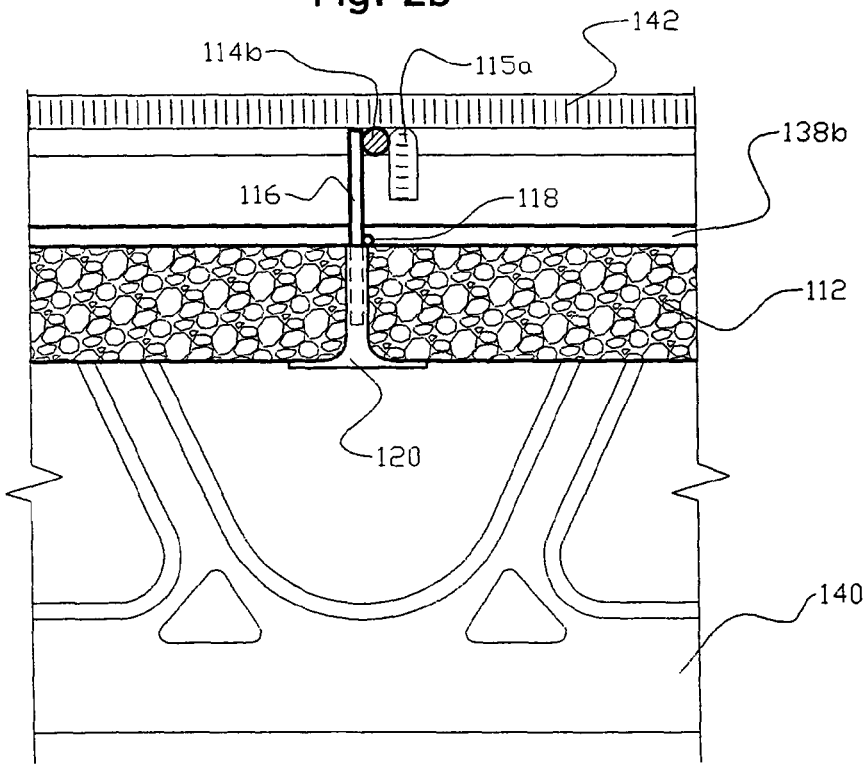
FIG. 2*c* is a fragmented longitudinal cross-sectional view at 2*c*-2*c* in FIG. 2*b;*
Figure 3:
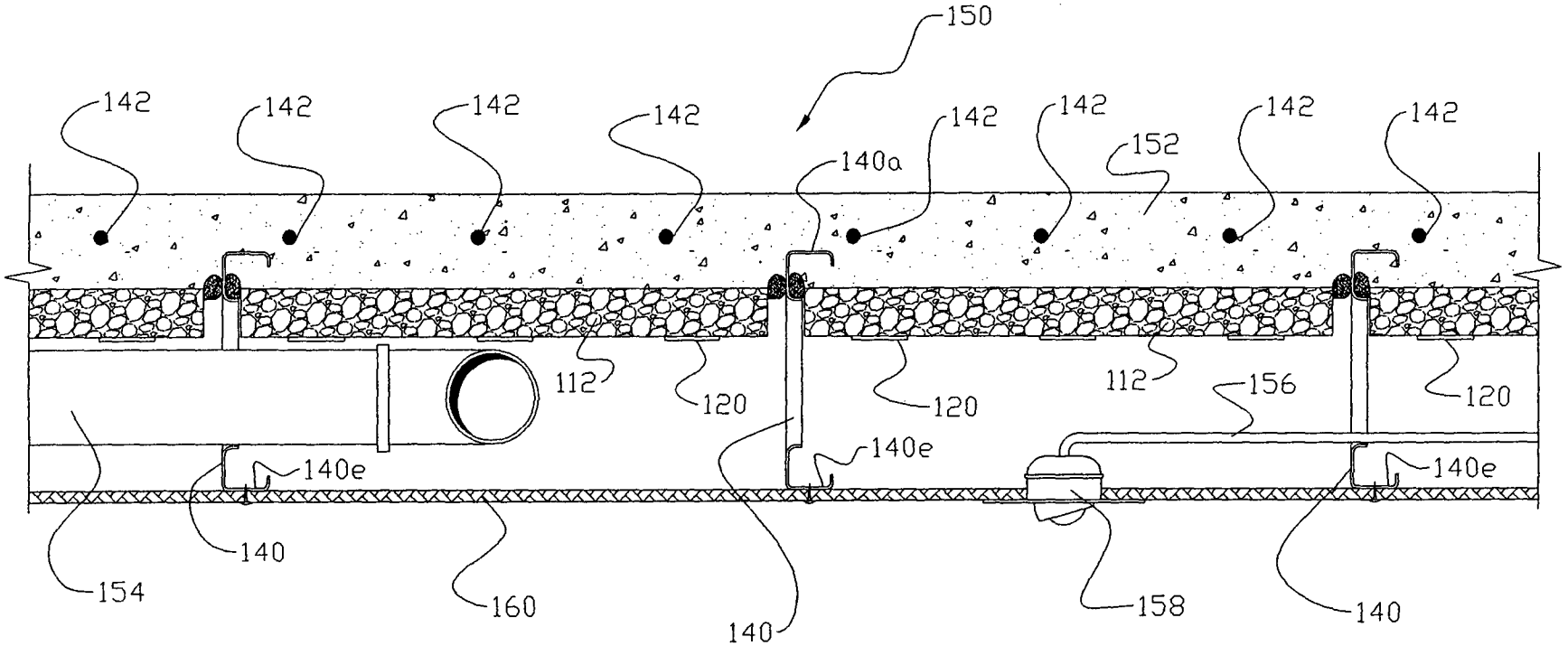
FIG. 3 is an fragmented transverse cross-sectional view of a floor/ceiling system employing several of the form panel units of FIG. 1 in a ceiling and floor structure with several supporting beam members embedded into the reinforced concrete floor slabs and connected with ceiling structures.

With reference now to FIG. 3, part of a structural ceiling and floor structure 150 employing the form panel units 110, is shown. Ceiling structure 150 is formed with a concrete slab 152 reinforced with longitudinal reinforcement members 142 which are supported in the manner shown in FIGS. 2*b* and 2*c* by form panel units 110 which are partially obscured by the concrete material of concrete slab 152 in FIG. 3. Beams 140 which in this example embodiment, have transverse openings 141 through their vertical web, are embedded into the reinforced concrete floor slabs above and connected with ceiling structures below. Schematically, the installed vent ducts and wiring with electric fixtures are shown.

The bottom flange web 140*e* of each of the beams 140 has a downward facing surface to which can be attached with conventional attachment devices such as screws, to a ceiling panel material 160, such as particleboard or drywall panel or other suitable ceiling panel.

Additionally, in the space between insulating foam panel 112 and ceiling panel 160, a space is provided which can be utilized for incorporating therein items such as duct work pipes 154 for air-conditioning, heating or the like, as well as electrical conduits such as electrical conduit 156 which can be interconnected to a light fixture 158 or other electrical device. If steel beams or joists with openings, such as Thermasteel™ (Canada), Dietrich TradeReady® (USA), Speedfloor (New Zealand), Komdecke™ (Chech Republic) and others are used, it is possible to install utilities piping and wiring passing transversely through the openings 141 in the beams 140, without any significant reduction of the beams' load bearing capacity.

It should be noted that, once the concrete has been poured into the form, part of which is provided by the panels 112 at the bottom, and by other conventional form work at the sides (not shown), the upper web portion including transverse upper flange 140*a* in each of the beams 140 is embedded within the concrete slab 152. One of the benefits of such an arrangement is that, in the case of a fire, the beam member 140 will tend to be held in place in the concrete, which will hold up the ceiling panels 160. Concrete that has flowed through apertures 180 assists in anchoring the beams 140 into the concrete slab. This will inhibit or completely prevent the plastic material from which foam panel 112 is made, if melted due to the heat, from falling down into the space beneath the ceiling structure and possibly injuring people in the room space below.

It will also be appreciated that in addition to the longitudinal reinforcement bar members 142, the horizontal reinforcement members 114 having served one of their functions in supporting the panel 112 which acts as a concrete form, once the concrete has hardened, also serves the function of providing transverse reinforcement for the slab 152.

It will be appreciated that concrete structures employing the form panel unit and beams of the present invention can be implemented and fabricated in different environments or situations.

For example, form panel units 110 can be pre-constructed at a manufacturing facility and shipped to a construction site. At the construction site, they can be mounted to beam members 140 which would be supported in conventional ways such as by structural support walls, other beam members or the like. Alternatively, pre-fabricated structural concrete slabs can be pre-fabricated at a manufacturing plant off-site, utilizing a beam arrangement supporting form panel units to form a pre-fabricated concrete panel structure. The pre-fabricated concrete slab can then be shipped to a construction site for installation in a particular application, including as a wall, floor or ceiling structure. It will therefore appreciated that if pre-fabricated in horizontal orientation at an off-site separate manufacturing facility, when shipped to a building site for installation, it is not necessary that the concrete slab structure be used in the actual building structure in a generally horizontal configuration.

Figures 4, 4A:
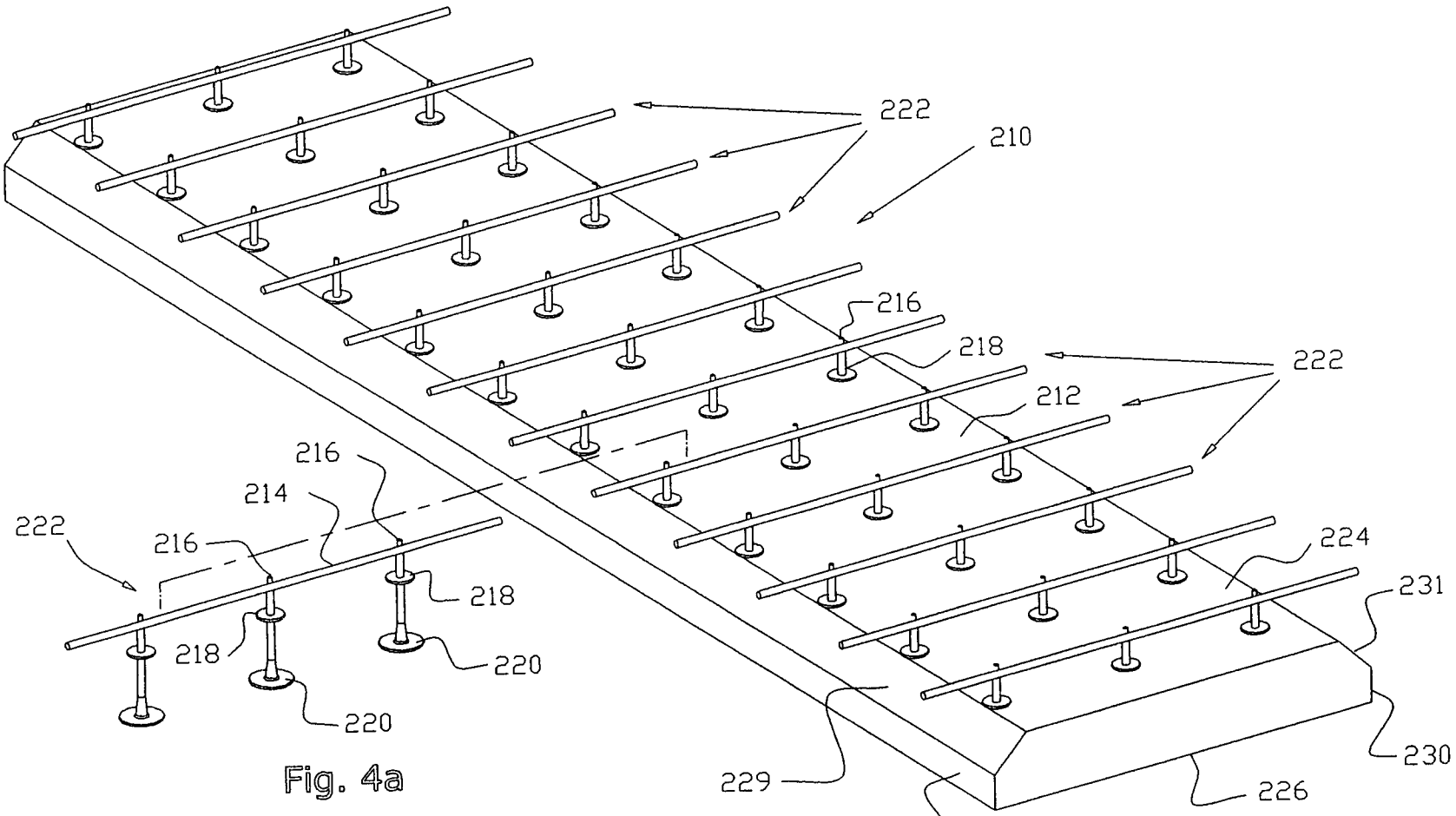
FIG. 4 is top perspective view of an alternate embodiment of a form panel unit.
FIG. 4*a* is a top perspective view of one of the alternate reinforcement unit to the reinforcement unit of FIG. 1*a*, as used in the form panel unit of FIG. 4.
Figure 4B:
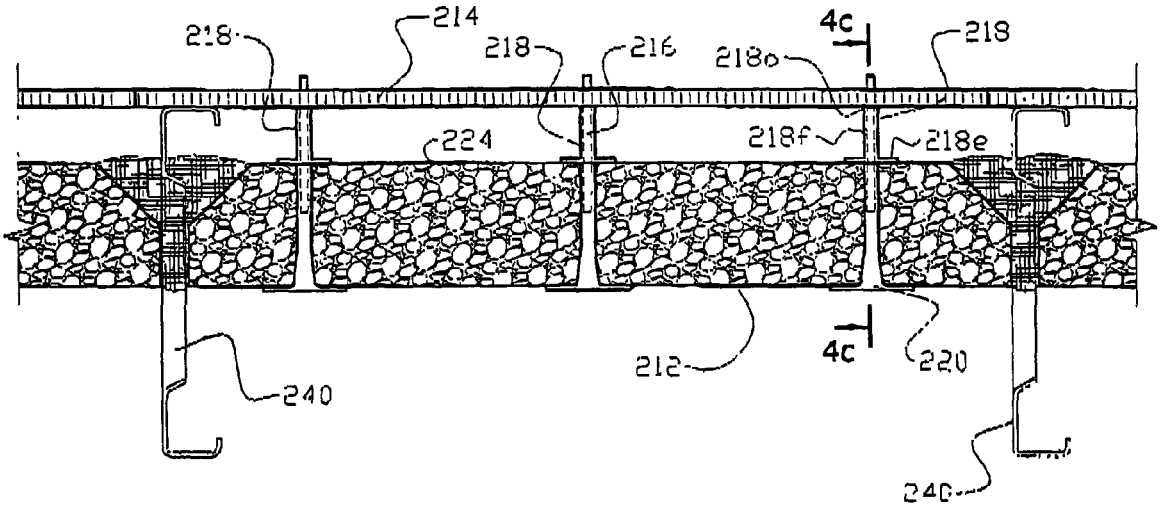
FIG. 4*b* is a fragmented transverse cross-sectional view illustrating the use of the form panel units of FIG. 4 supported by beams with an opening and illustrating the connection between adjacent form panel units.
Figure 4C:
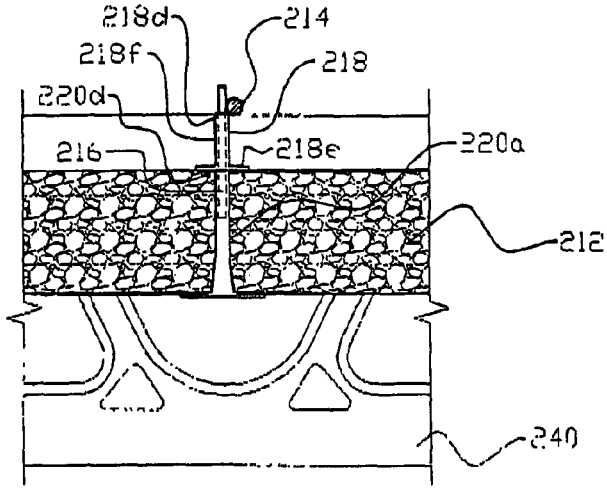
FIG. 4*c* is a fragmented longitudinal cross sectional view at 4*c*-4*c* in FIG. 4*b;*

With reference now to FIGS. 4, 4*a* and 4*b*, another embodiment of a form panel unit can be used in combination with structural support members to produce a structural concrete slab is illustrated. Form panel unit 210 includes a foam plastic panel 212, as described above and includes a plurality of longitudinally spaced generally transversely oriented reinforcement units 222.

As particularly shown in FIG. 4*a*, the reinforcement units 222 include reinforcement bar members 214, each comprising first and second supporting portions and reinforcement portions comprising vertical rod members 216 and connectors 220. As is evident in FIGS. 4 and 4*a*-4*c*, connector portions 220 each have a vertically extending shaft that is embedded within the panel 210 and an interconnected head that extends generally horizontally and is positioned proximate the lower surface of the panel 210 to provide support proximate the lower surface of the panel. Vertical rod portions 216 extend from proximate the upper surface and interconnect with the shafts of respective connector portions 220. Instead of a spacer rod like rod 118 in FIGS. 1 and 1*a* as described above, spacer flange members 218 are provided. As specifically shown in FIG. 4*b*, flange members 218 have a flange 218*e* and a shaft portion 218*f* having and end 218*d*. Shaft portion 218*f* and head portion 218*e* are mounted preferably for slidable movement on a portion of rod 216. Rod 216 also passes into a shaft portion 220*a* to connector 220, in a manner previously described in relation to connector 120. The end 220*d* of connector shaft portion 220*a* is also configured to engage head portion 218*e* of flange 218, when connector 220 is tightened on rod 216. In this way, as a connector 220 is tightened drawing the panel material 212 towards the reinforcement member 214, end 218*d* of shaft 218*f* will come into abutment with the reinforcement member 214, and connector end 220*d* will contact flange head 218*e*. In this way, the panel material 212 can be compressed to some degree between flange head 218*e* and the head of connector 220. This ensures a rigid or semi-ridged connection between form panel units 222 and panel 212 and also ensures proper spacing of reinforcement bar members 213 from the inner surface 224 of the panel 212.

It will also be noted that reinforcement bar members 214 do not have hooked ends and when installed as shown in FIG. 4*b* on beams 240, reinforcement bars 214 of one form panel unit do overlap, as in the previous embodiment with its bars 114, with reinforcement members 214 of an adjacent form panel unit 210. As in the prior embodiment of FIG. 2, in the embodiment of FIGS. 4 to 4*c*, reinforcement bars 214 and the portions thereof that are supported on beam members 240 are positioned proximate to upper surface 224 of panel member 212 and are closer to upper surface 224 than to lower surface 226 of panel member 212.

As shown, the sealing mechanism between adjacent form panel units 210 and the supporting members, is different than in the previous embodiment. In this embodiment, the side surfaces 228 and 230 of the panels 212 have sloped portions 229 and 231, respectively. These two panels are brought into generally abutting relation on either side of a beam member 240. Thereafter, an expandable foam can be injected or otherwise placed into the generally V-shaped channel formed with each arm of the V-shaped channel positioned on either side of the central web of beam 240. An example of a suitable expandable foam is a standard foam of the type used for sealing windows or doors. It would be appreciated that this mechanism and system can be utilized when a thicker foam panel 212 is required for extra insulation value.

Figures 5, 5A:
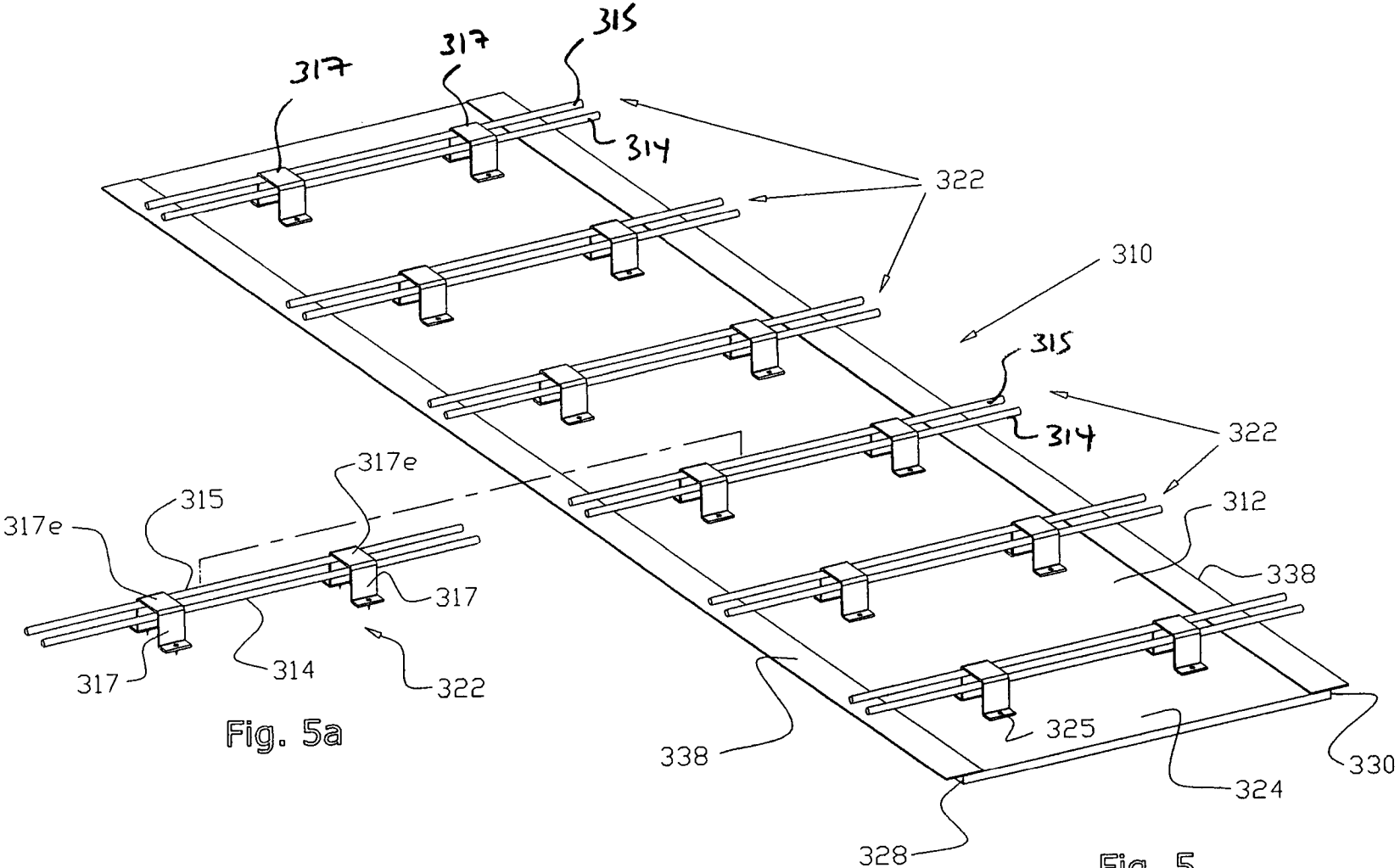
FIG. 5 is a top perspective view of another embodiment of a form panel unit.
FIG. 5*a* is a detailed perspective view of one of the several reinforcement units used in the form panel unit of FIG. 5.

With reference now to FIGS. 5 and 5*a*, another embodiment is illustrated in which the form panel unit 310 includes a panel member 312 comprising particle boards, oriented strength boards (OSB), plywood, cement-bonded particle boards (CBPB) and the like and which may in some embodiments have a thickness of between 5/16 inch to 1 inch.

Each of the reinforcement unit 322 that are mounted to the panel unit 312 includes a pair of longitudinally spaced reinforcement bar members 314 and 315, each being welded to or otherwise secured to the underside of a top plate 317*e* of a U-bracket 317. A pair of U-brackets, which can be made from a metal such as for example, steel or aluminum, and transversely spaced are provided for and secured to the reinforcement bars 314, 315 in each reinforcement unit 322. Of course, it is not necessary that it be a U-shaped bracket or that there be two reinforcement bar members, however the reinforcement members 314, 315 should be spaced from the upper surface 324 of panel 312. The U-brackets can be secured to the upper face 324 of the panel 312 using conventional attachment devices such as plywood, particle board self-threaded screws or the like 325. Adjacent to the longitudinally extending side edges 328 and 330 and mounted on upper surface 324 and extending past the side edges 328 are rubber strips 338 providing seals as described above. The rubber strips are made of a suitable resilient rubber such as the kind of rubber material used for door and gates sealing.

Figure 5B:
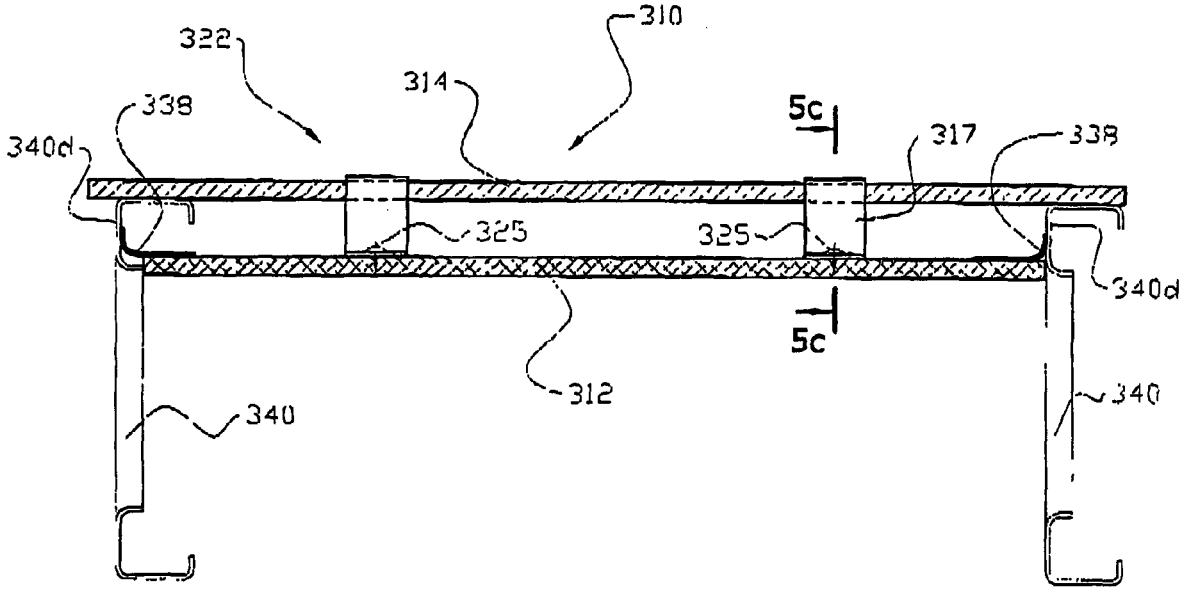
FIG. 5*b* is a fragmented transverse cross-sectional view of a form panel unit of FIG. 5 suspended from and sealingly suspended between a pair of supporting beam members.
Figure 5C:
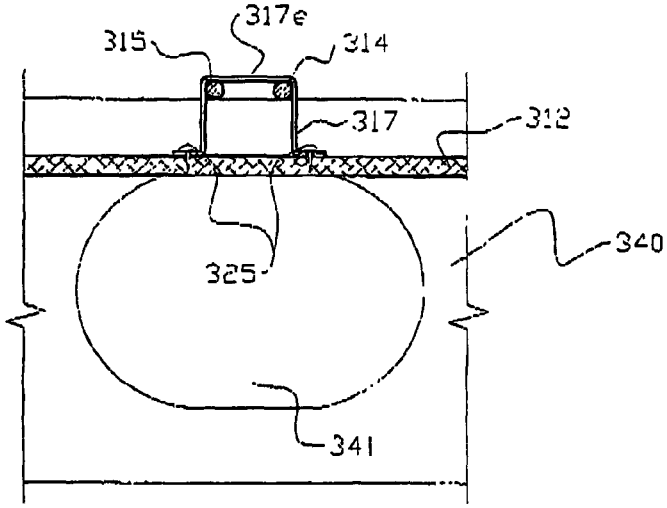
FIG. 5*c* is a fragmented longitudinal cross sectional view at 5*c*-5*c* in FIG. 5*b;*
Figure 5D:
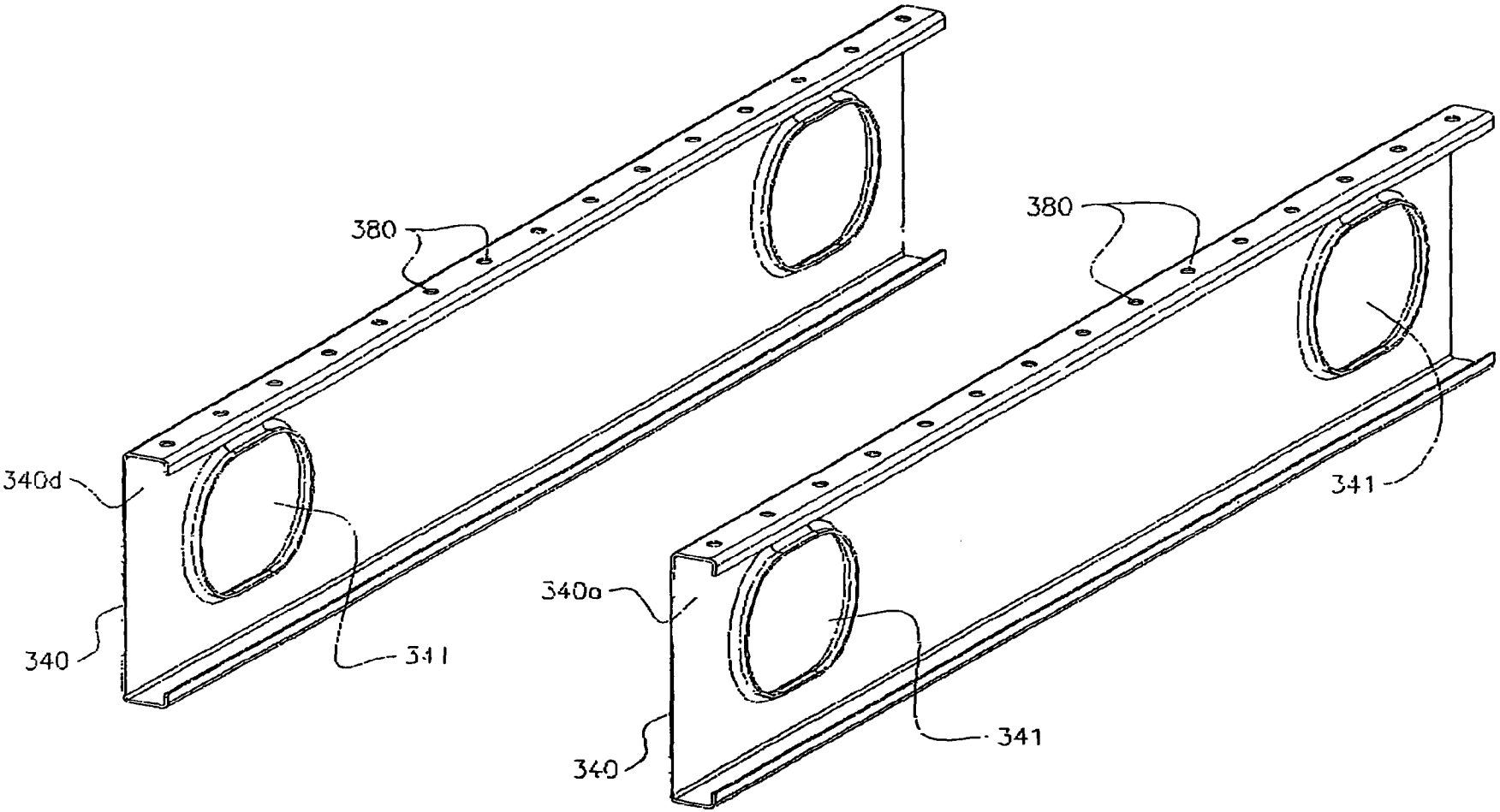
FIG. 5*d* is a top perspective of a pair of supporting beam members in isolation, as employed in the system of FIGS. 5*b* and 5*c;*

As shown in FIGS. 5*b*, 5*c* and 5*d*, the supporting beam members 340 which may be Dietrich TradeReady® steel joists (Dietrich Metal Framing, 500 Grant Street, Suite 2226, Pittsburgh, Pa., 15219, USA) have transverse apertures 341 passing through the vertical web portions. Beams 340 are generally C-shaped channel, beam members, and in this embodiment as in the previous embodiments, are oriented in the same (face to back) direction. Beams 340 also have apertures 380 which function like apertures 180 in beams 140, as described above. Form panel units 310 may be mounted onto beams 340 in a manner similar to that shown in FIGS. 2 and 2*a* with respect to form panel units 110 and in FIGS. 4 and 4*a* with respect to form panel units 210.

It will be noted that sealing strips 338 are displaced and due to their resiliency will exert a force against the web surface of the upper web portion 340*d* of the beam 340, thus providing a seal between the panel 312 and the beam members 340. This provides a suitable part of a form for the placement of unhardened concrete to form a concrete slab (not shown).

Figures 6, 6A, 6B:
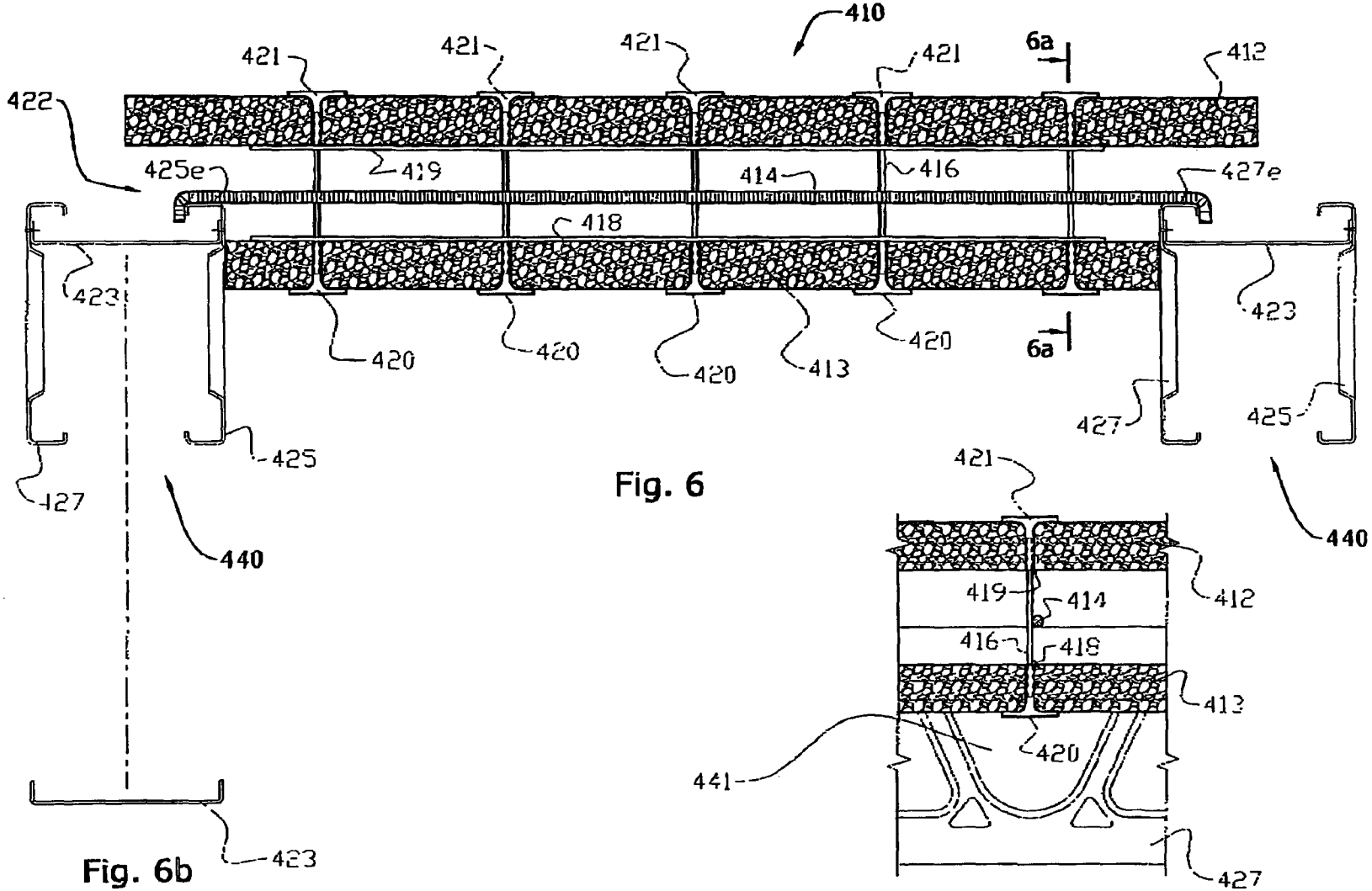
FIG. 6 is transverse cross-sectional view of an alternate embodiment of a form panel unit suspended between composite supporting beam members in an opening therebetween.
FIG. 6*a* is a fragmented longitudinal cross sectional view at 6*a*-6*a* in FIG. 6.
FIG. 6*b* is a front elevation view of a channel member forming part of the composite beam member of FIG. 6.

Now with reference to FIGS. 6, 6*a* and 6*b*, another embodiment is illustrated. In this embodiment, form panel unit 410 comprises an upper foam plastic panel 412 and a lower foam plastic panel 413. Panels 412 and 413 are generally in spaced longitudinal and transverse parallel alignment.

Panels 412 and 413 are rigidly held in such space relation by reinforcement units 422. Reinforcement units each comprise rod members 416 having at one end, connectors 421 secured and attached thereto and at the other end, connectors 420 attached thereto. Connectors 421 and 420 can be like connectors 120 but connect to rods 416 at each end in the same manner. Panel 413 is held in slight compression between spacer bar 418 which is rigidly interconnected and secured to rods 416 and connectors 420. Likewise panel 412 is held in slight compression between connectors 421 and spacer rod 419. Positioned in vertically spaced relation to both panel 412 and rod 419 on the one hand and spacer rod 418 and panel 413 on the other, is central transverse reinforcement bar member 414. Thus, the combination of panels 412, 413 and several longitudinally spaced, reinforcement units 422 (in transverse parallel relation), comprised a rigid unit which is suitable for being mounted and suspended on composite beam members 440.

Figure 6C:
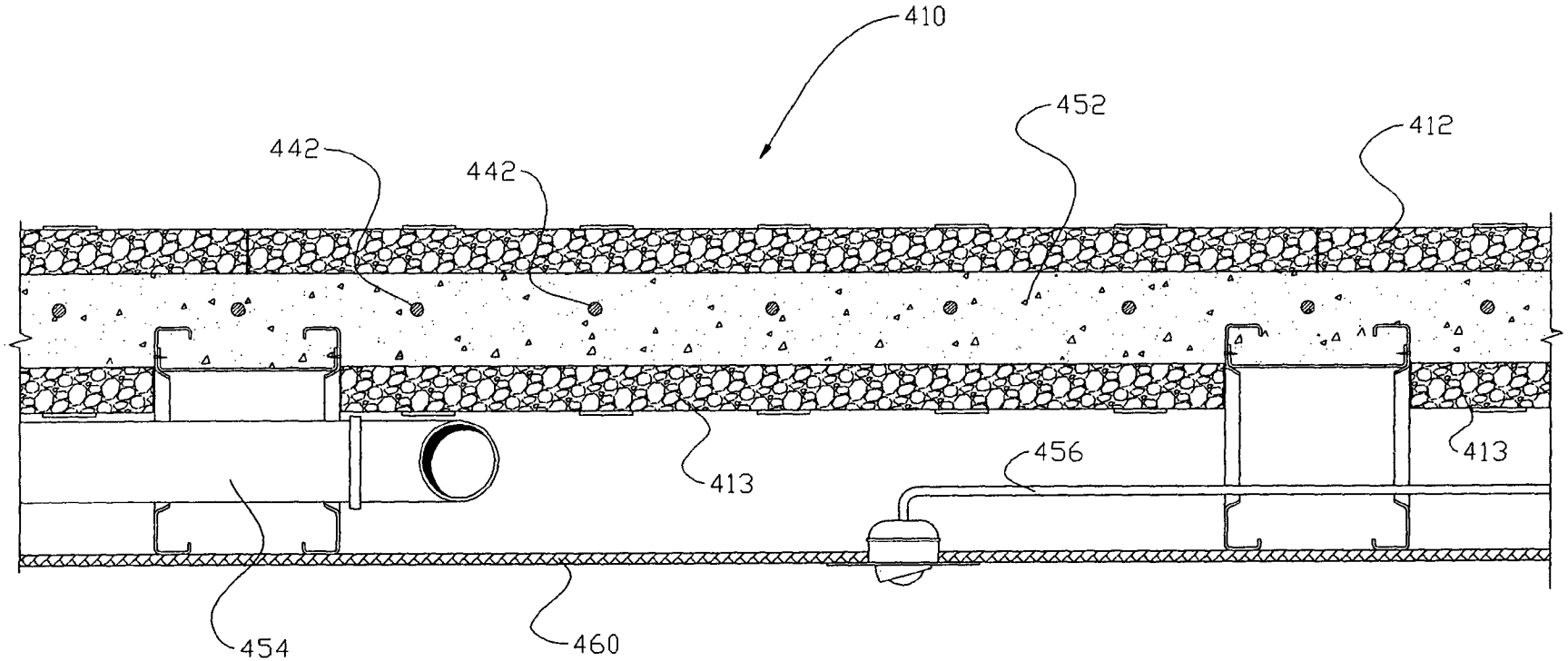
FIG. 6*c* is a fragmented transverse cross-sectional view of a floor system employing several of the form panel units of FIG. 6 in a ceiling structure with several composite beam members embedded into the reinforced concrete floor slabs and connected with ceiling structures.
Figure 6D:
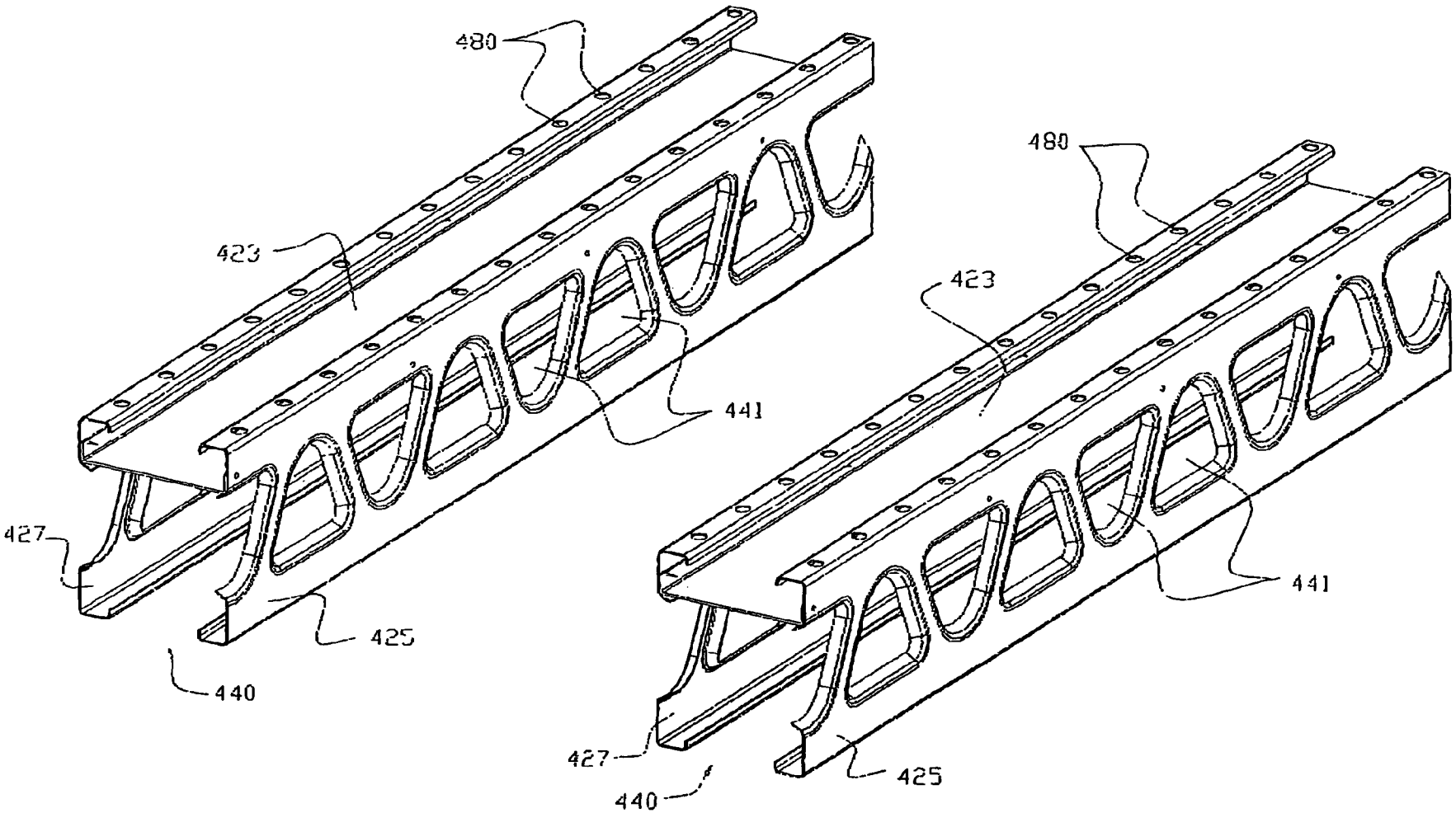
FIG. 6*d* is a top perspective of a pair of composite supporting beam members in isolation, as employed in the system of FIGS. 6 and 6*a;*

As shown in FIG. 6*d*, composite beam members 440 each include a pair of generally C-shaped channel beams 425, 427 oriented in face-to-face relation and interconnected to each other by a generally U-shaped longitudinally extending channel member 423 which can be made for example from tin with gauge 18 or other suitable materials, and which interconnects to an upper web portion of each of beams 427 and 425 by structural connectors such as self-threaded screws. Each of beams 425 and 427 has aligned transverse apertures 441, like apertures 141, to permit the passage of ducts and wiring and the like. Also, each of beams 425, 427 has vertically opening apertures 480 which function like apertures 180 as described below.

The transverse width of panel 413 is selected to produce a tight compression fit against the upper web portion of a beam 425 of one of a pair of spaced composite beams 440 and against the upper web portion of a beam 427 of the other of the pair of spaced composition beams 440, as shown. In this embodiment, the panel unit 410 can simply be lowered more of less straight vertically down, with the panel 413 being pressure fit between beams 440. In the embodiment shown, no additional sealing mechanism or device is provided between the panel 413 and the beam members. If desired, however, sealing mechanisms between panel 413 and the surfaces of the beams 425, 427 could also be provided.

The form panel unit 422 is mounted onto upper transversely extending web portions 425*e* and 427*e* of beam members 425 and 427 respectively. It will be noted that reinforcement bars 414 each have hooks at their ends to facilitate a connection with the flange portions 425*e* and 427*e* of the beam members. In this embodiment, concrete is poured into the space between panels 412 and 413 to provide a structural concrete slab as shown in FIG. 6*c*. Additionally, below panel 413, as shown in FIG. 6*c*, space is provided between a sealing panel 460 and the lower surface of foam panel 412 for duct work 454 and electrical conduits 456 and the like, similar to as described above. The apertures 441 in the beam members 440 allow passage of such items. Structural slab 452 thus is provided once the concrete has hardened and has insulation from panels 412 and 413 on both sides. Additionally, longitudinal reinforcement members 442 can be provided for longitudinal strengthening of the slap. Such members 442 could be placed between panels 412, 413 prior to the concrete pour and can be positioned to rest on horizontal members 414.

Figure 7:
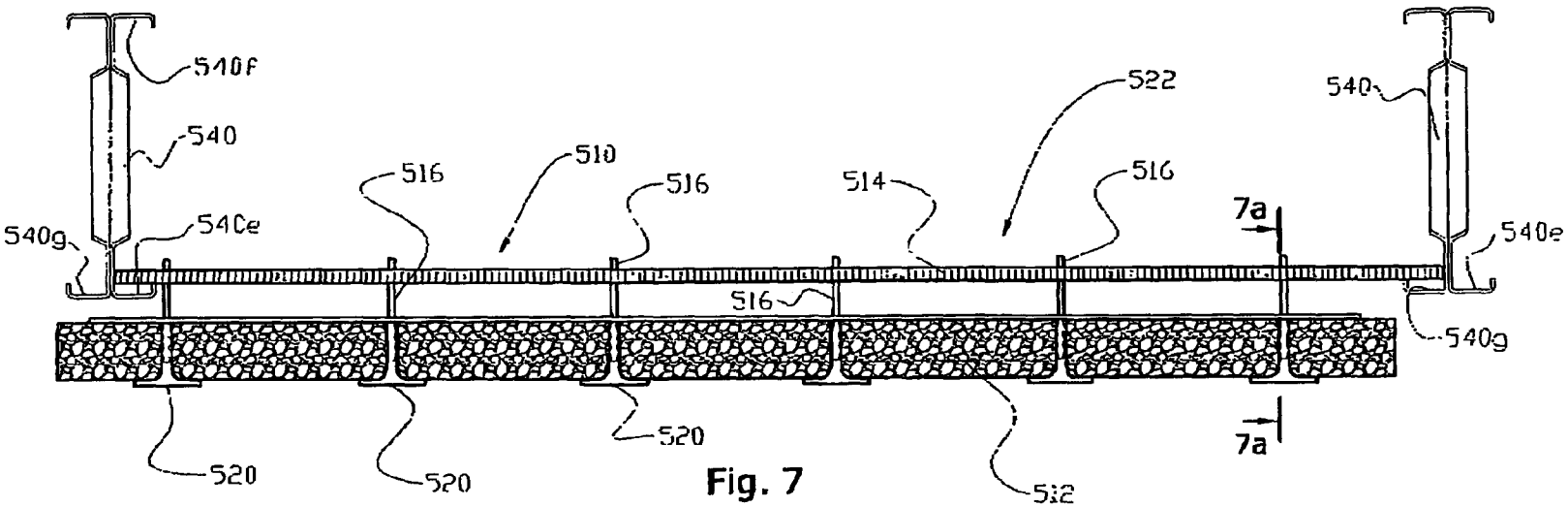
FIG. 7 is a transverse cross-sectional view of another embodiment of a system employing an alternate form panel unit suspended between composite beam members with an opening.
Figure 7A:
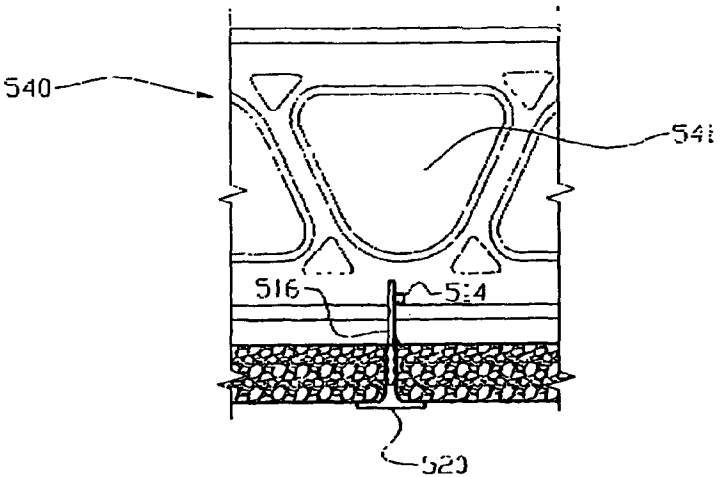
FIG. 7*a* is a fragmented longitudinal cross sectional view at 7*a*-7*a* in FIG. 7; and, FIG. 7*b* is a fragmented transverse cross-sectional view of a floor system employing several of the form panel units of FIG. 7 in a ceiling structure with several composite beam members embedded into the reinforced concrete floor slabs and connected with ceiling structures.
Figure 7B:
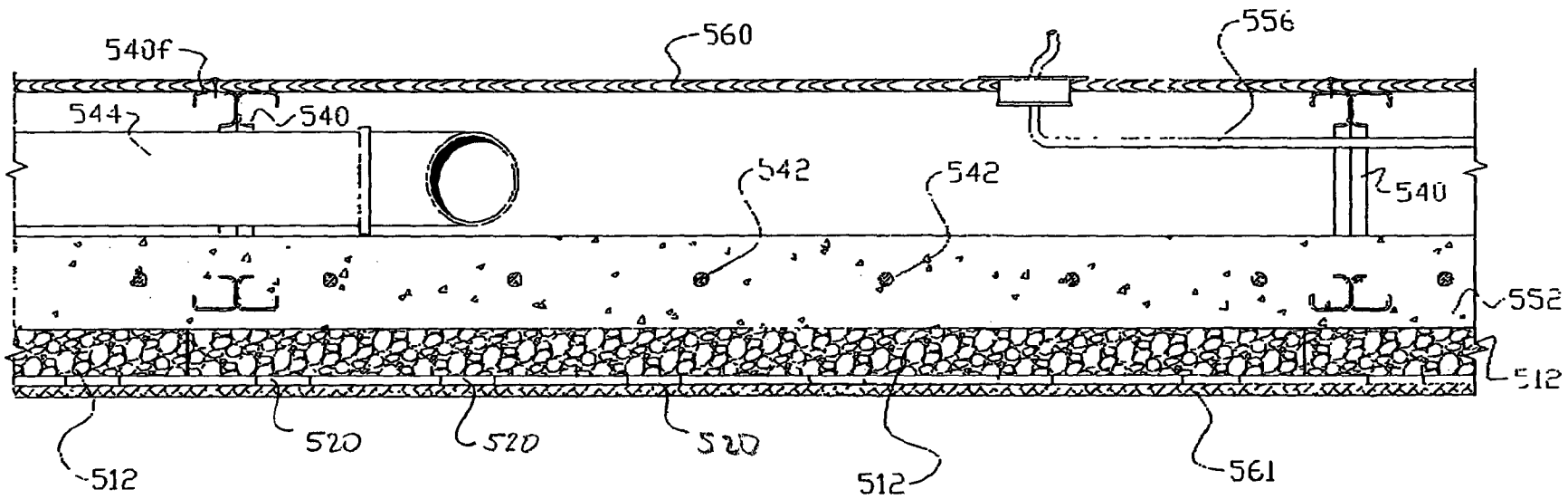
FIG. 7*c* is a top perspective of a pair of composite supporting beam members in isolation, as employed in the system of FIGS. 7, 7*a* and 7*b;*
Figure 7C:
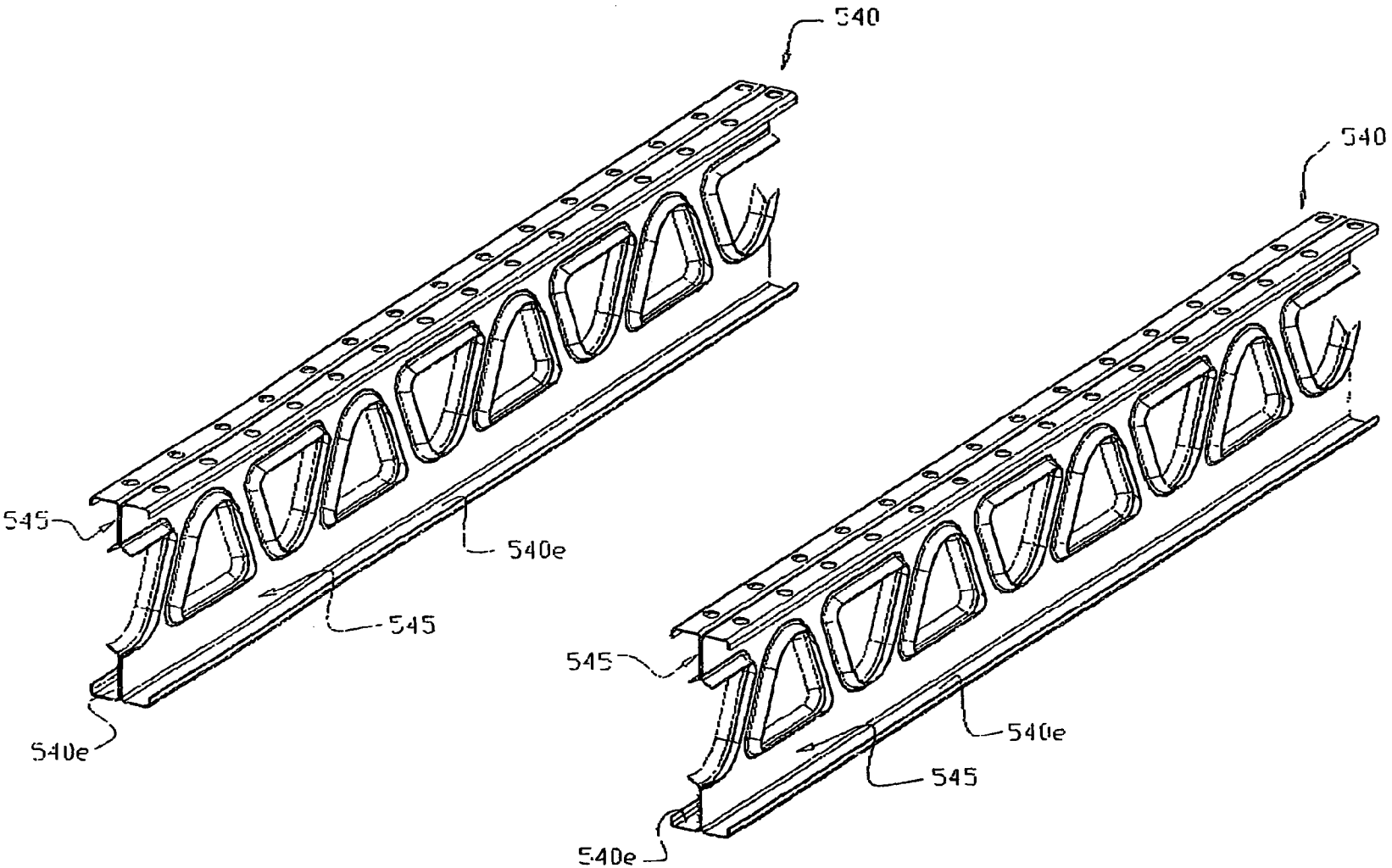

With reference to FIGS. 7, 7*a* and 7*b* a form panel unit 510 is constructed similar to form panel 110 as described above each having a panel 512 and one or more reinforcement units 522. Each reinforcement unit has at least one reinforcement bar 514, vertical rod 516 joined thereto and connectors 520. However, foam plastic panel 512 is suspended from the lower web 540*e* at each end by ends of reinforcement bar 514. Beam members 540 are composite I-beams formed from a pair of generally C-shaped channel beam members structurally secured to each other in back-to-back relationship. As shown in FIG. 7*c*, each composite beam member 540 is formed with two back to back channel members 545 joined in back to back relation by conventional mechanisms such as by way of example, welding, structural bolts etc. Each channel beam 545 is constructed like beam members 140 described above. For the purpose of installation of the formwork panel unit 510, the positioning of panel 512 in relation to the reinforcement member 514 (and thus the beams 540) is such that panel 512 has one side that extends beyond the center of the joined channel beams. The other side is the same distance short from the center of the joined channel beams of the adjacent support member 540. The formwork units 510 are suspended from the bottom webs 540*e* by inserting one end of the reinforcement bars 514 into the cavity between beams 540 and afterwards the opposite end of the reinforcement bars 514 is inserted in the same cavity. Afterwards, the ends of the reinforced bar 514 are lowered to the flanges 540*f* and 540*e* by lowering one side edge onto flange 540*e* and then rotating the opposite side edge of the panel relative to the other edge of the panel 510 in a manner similar to the rotation of the reinforcement units 122 and panel 112 in FIG. 2*a*.

As shown in FIG. 7*b*, form panel unit 510 is utilized in the construction of a concrete reinforced floor slab 552 which includes a floor panel material 560 such as by way of example, plywood which is supported on and secured to the upper web surfaces 540*f* of beams 540. Also the floor construction incorporates duct work pipe 544 and electrical conduit 556. The panels 512 of transversely adjacent panel units 510 are shown to be in abutment with each other to provide for thermal and acoustic insulation. Additionally, ceiling panel 561 is secured beneath panel 512 by anchor screws attached to the concrete reinforced floor slab 552 through panel 512 or attached by self-threaded screws to connectors 520 installed in panel 512. Ceiling panel 561 may by way of example be made of materials such as drywall, gypsum plates, cement board, cement bonded particle boards etc. Is should also be noted that in this embodiment, slab 552 includes longitudinal reinforcement members 542.

Figure 8:
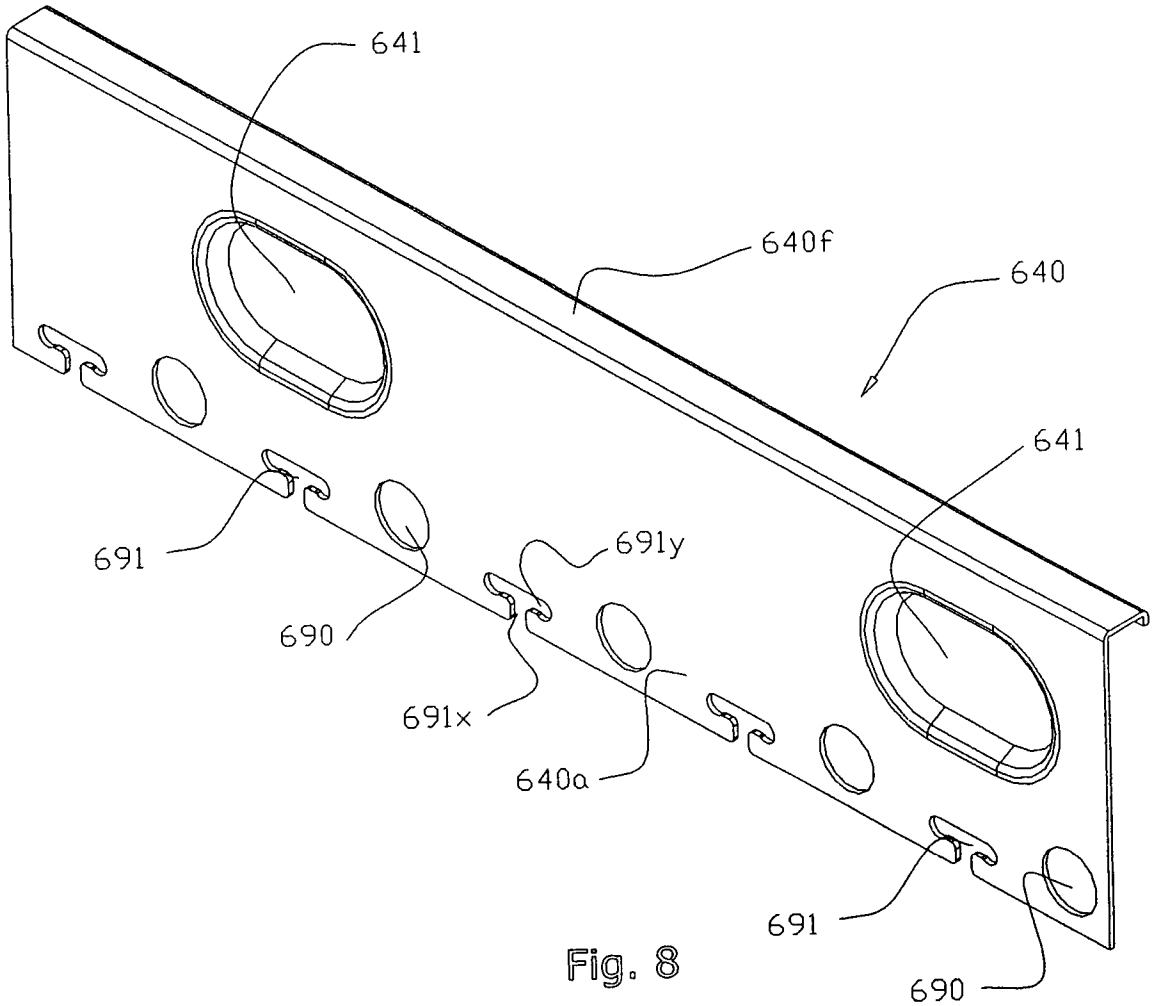
FIG. 8 is perspective view of a beam member in accordance with another embodiment of the invention.

With reference now to FIG. 8, a support member 640 which can function as a beam, joist or other support member, is shown. Beam 640 can be made of known beam materials, such as for example, steel, aluminum and certain composite materials. Beam 640 is generally configured to be used in an inverted L-shape having a vertical web 640*a* and a transverse short leg portion 640*f*. Transversely formed through web 640*a* are apertures 641 which are suitable for receiving therethrough ductwork, electrical conduits or the like. Additionally, in a lower portion of web 640*a* are apertures 690 and T-shaped apertures 691 positioned in spaced relation longitudinally along the web 640*a*.

Figure 8A:
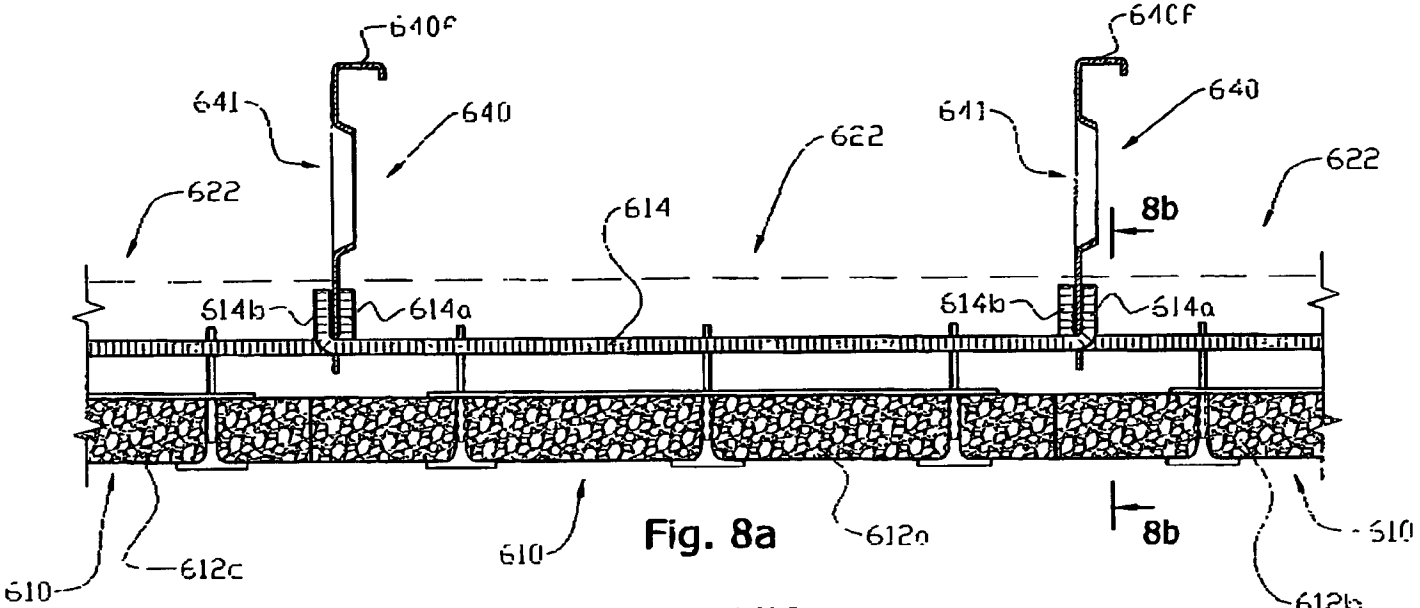
FIG. 8*a* is a transverse cross-sectional view of another embodiment of a system employing an alternate form panel unit suspended between a pair of beam members of FIG. 8.
Figure 8B:
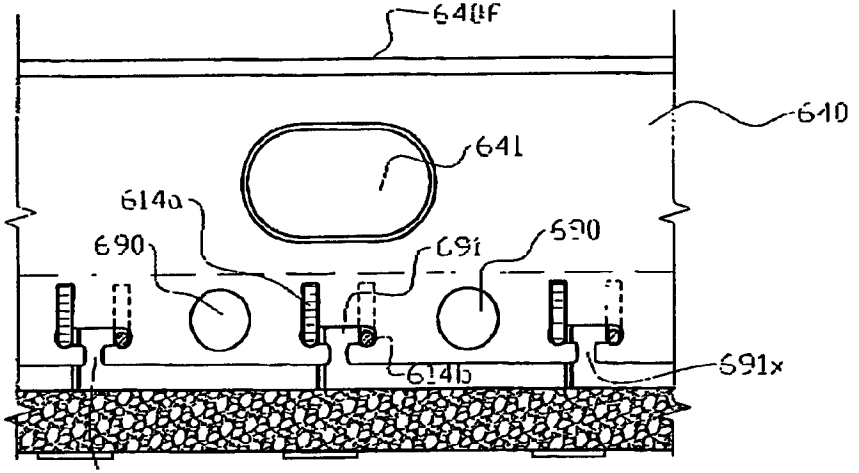
FIG. 8*b* is a fragmented longitudinal cross sectional view at 8*b*-8*b* in FIG. 8*a;*

As shown in FIGS. 8*a* and 8*b*, a pair of spaced beams 640 support a panel unit 610 having a plurality of reinforcement units 622 which are constructed in a manner similar to the panel units described above. Panel units 610 are shown in abutting relation to provide a form for a floor/ceiling slab structure, similar those described above. Reinforcement member 614 of each panel unit 610 has upturned end hook portions at each end. As shown in FIG. 8*b*, the reinforcement unit 622 of each panel unit 610 can be mounted and suspended from beams 640 (which are preferably oriented in face-to-back relation but can be in face to face relation) by moving the reinforcement units 622 of a panel unit 610 from below upwards and then inserting the horizontal portions of members 614 adjacent the apertures 691, vertically upwards in trunk portion 691×of aperture 691, and then moving the member 614 transversely into a leg portion 691*y*. This movement will put the members 614 into a position whereby panel unit 610 can be suspended from the beams 640. The hooked portion 614*a*, 614*b*, of each of the members 614 prevent any significant transverse displacement of panel unit 610 and to some extent lock the members 614 in an appropriate formwork position. Additionally, it will be observed from FIG. 8*b*, that one end portion 614*a* of one members 614 of one reinforcement unit 622, and opposite end portion 614*b* of a member of another reinforcement unit 622, can fit into opposite leg portions 691*y* of the same aperture 691.

When the concrete is poured into the form of FIG. 8*b*, concrete will abut the lower portion of web 640*a* and will flow into apertures 690 and the remaining vacant space in apertures 691. Concrete flowing into apertures 690 in particular will provide once the concrete has hardened, anchors for the beams 640. This will serve to help support the panel units including panel 612, including during any fire.

Figure 9:
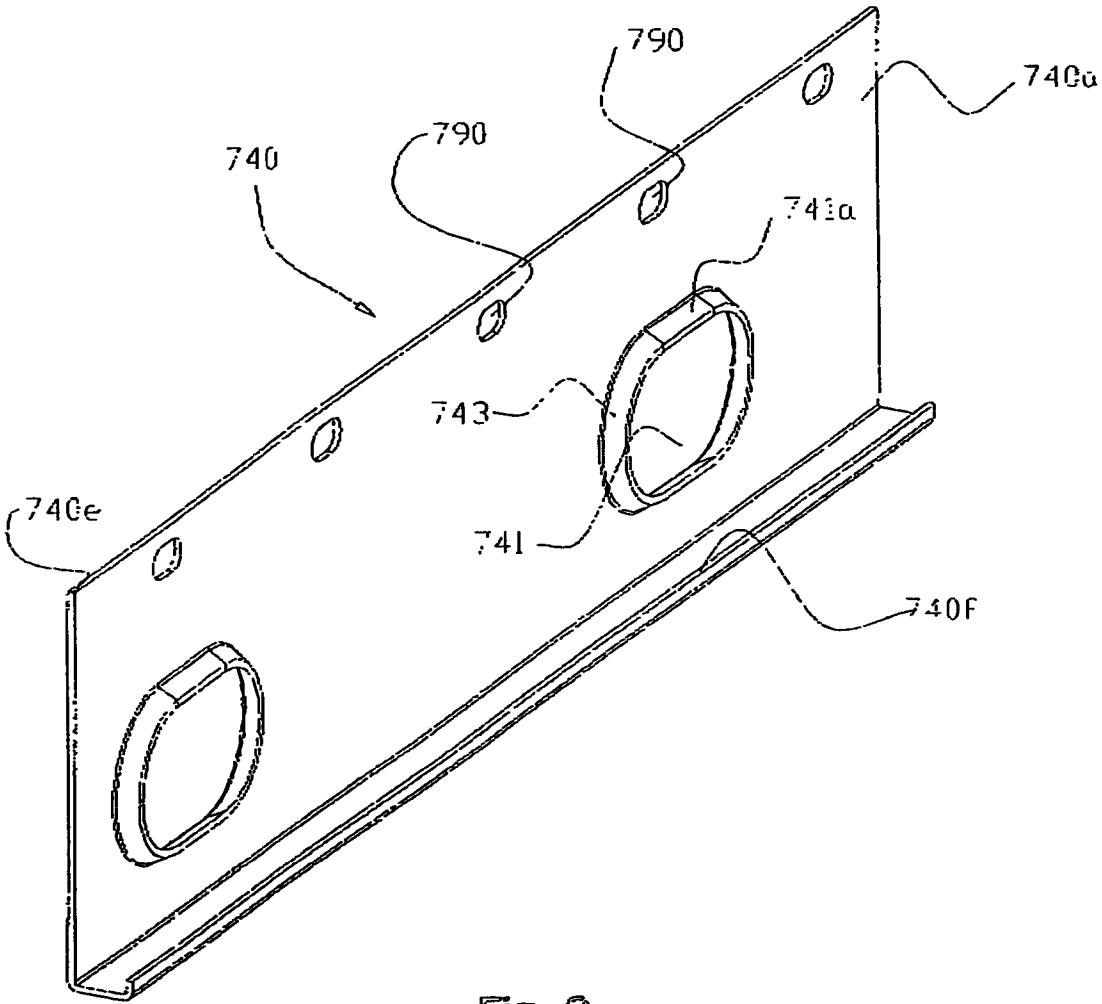
FIG. 9 is perspective view of a beam member in accordance with another embodiment of the invention.

With reference now to FIG. 9, a support member 740 which can also function as a beam, is shown. Beam 740 can, like the other support members described herein be made of normal beam materials, such as for example, steel, aluminum and certain composite materials. Beam 740 is generally configured to be used in an L-shape having a vertical web 740*a* and a transverse short lower leg portion 740*f* and an upper edge 740*e* on central web 740*a*. Transversely formed through web 740*a* are apertures 741 which are suitable for receiving therethrough ductwork, electrical conduits or the like. Apertures 741 have flanges 742 with upper flange surfaces 741*a*. Additionally, in an upper portion of web 740*a* are apertures 790 positioned in spaced relation longitudinally along the upper portion of the web 740*a*.

Figure 9A:
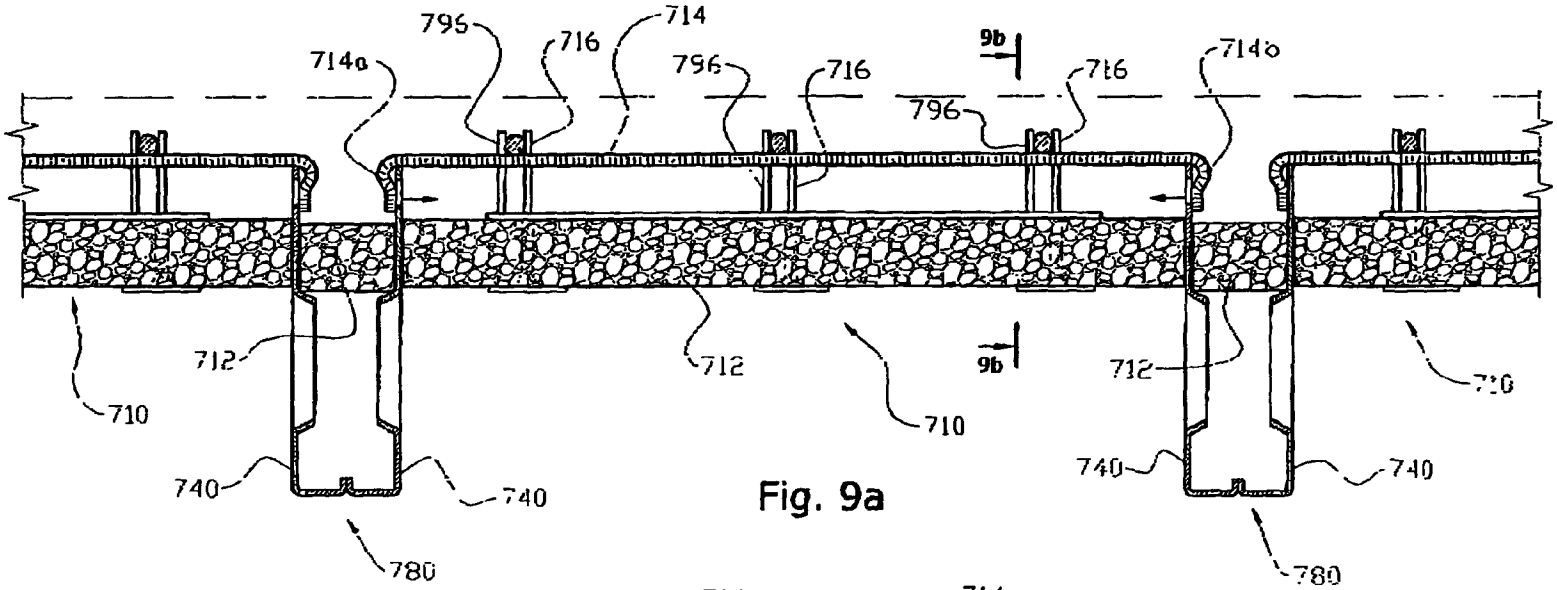
FIG. 9*a* is a transverse cross-sectional view of another embodiment of a system employing an alternate form panel unit suspended between two spaced composite U-beam members, each composite U-beam member formed from a pair of beam members in accordance with FIG. 9, joined together in face to face relation.
Figure 9B:
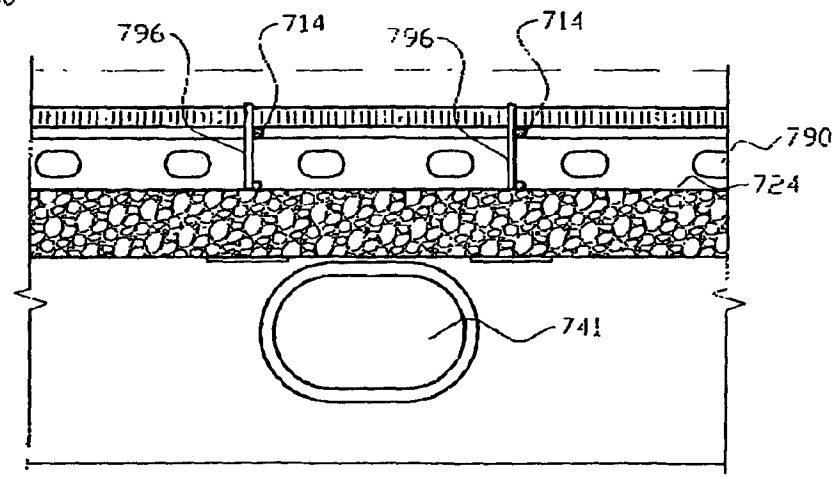
FIG. 9*b* is a fragmented longitudinal cross sectional view at 9*b*-9*b* in FIG. 9*a*.

As shown in FIGS. 9*a* and 9*b*, a pair of composite beams 780 is shown each comprising a pair of beam members 740 joined together by welding or other known connection devices or methods, in face to face relation. Each composite beam 780 supports one side of a panel unit 710 on reinforcement units 722. Thus, a panel unit 710, comprising a panel 712 and at least one reinforcement unit, is supported on each side by a beam member 740 of a composite beam 780. Each panel unit 710 will be in most but not all embodiments, be supported by at least two, spaced, transversely oriented reinforcement units 722.

A panel 712 of a panel has side surfaces in abutting relation to the upper portion of webs 740*a* of a pair of spaced beam members 740, 740 that are in back to back relation. The side surfaces engage the vertical web beneath apertures 790.

It will be noted from FIG. 9*b* that the upper surface 724 of panel 712 is positioned below the lower edges of apertures 790 in each beam member 740. The panel units 710 provide part of a form for a floor/ceiling slab structure, similar to those described above.

With reference to the reinforcement units, which are constructed in a manner similar to the units described above, reinforcement members 714 each have down-turned end hooks portions 714*a*, 714*b* at each end. End portions 714*a*, 714*b* hook over the upper edges 740*e* of their respective beams 740. Compressive forces are imparted on the upper portions of webs 740*a* and the friction between the hook portion and the web of the beam will also resist any tendency for the member 714 to move upwards off the supporting beam webs 740*a*. As shown in FIG. 9*a*, the hook portions have a portion that curves outward and then inward and are configured to provide a spring-like effect. Accordingly, when end portions of members 714 are attached as shown, each of the reinforcement units 722, will be relatively securely mounted and suspended from beams 740. In this embodiment, a pair of beams is arranged face to face relation at each junction of reinforcement units 722.

A separate panel portion 1712, typically of the same material as panel 712 (which like the other panel members will be like those panels described above) is friction fit between the inward facing surfaces of beam members 740, and are positioned in alignment with adjacent panel members 712. Additionally, panel portions 1712 can be supported on the upper flange surfaces 741*a*.

When the concrete is poured into the form of FIGS. 9*a* and 9*b*, concrete will abut the upper portion of web 740*a* at the level of upper surface 724 or panel 712, Concrete will flow into apertures 790 and will provide, once the concrete has hardened, anchors for the beams 740. This will serve to help support the reinforcement unit 722 including panel 712, including during any fire.

Additionally vertical rods 716 which are joined to connectors 720 at their lower ends, combine with ancillary vertical rods 796 which are welded to member 714 to provide cells each for assisting in holding one or more longitudinal reinforcement members 742.

Figure 10:
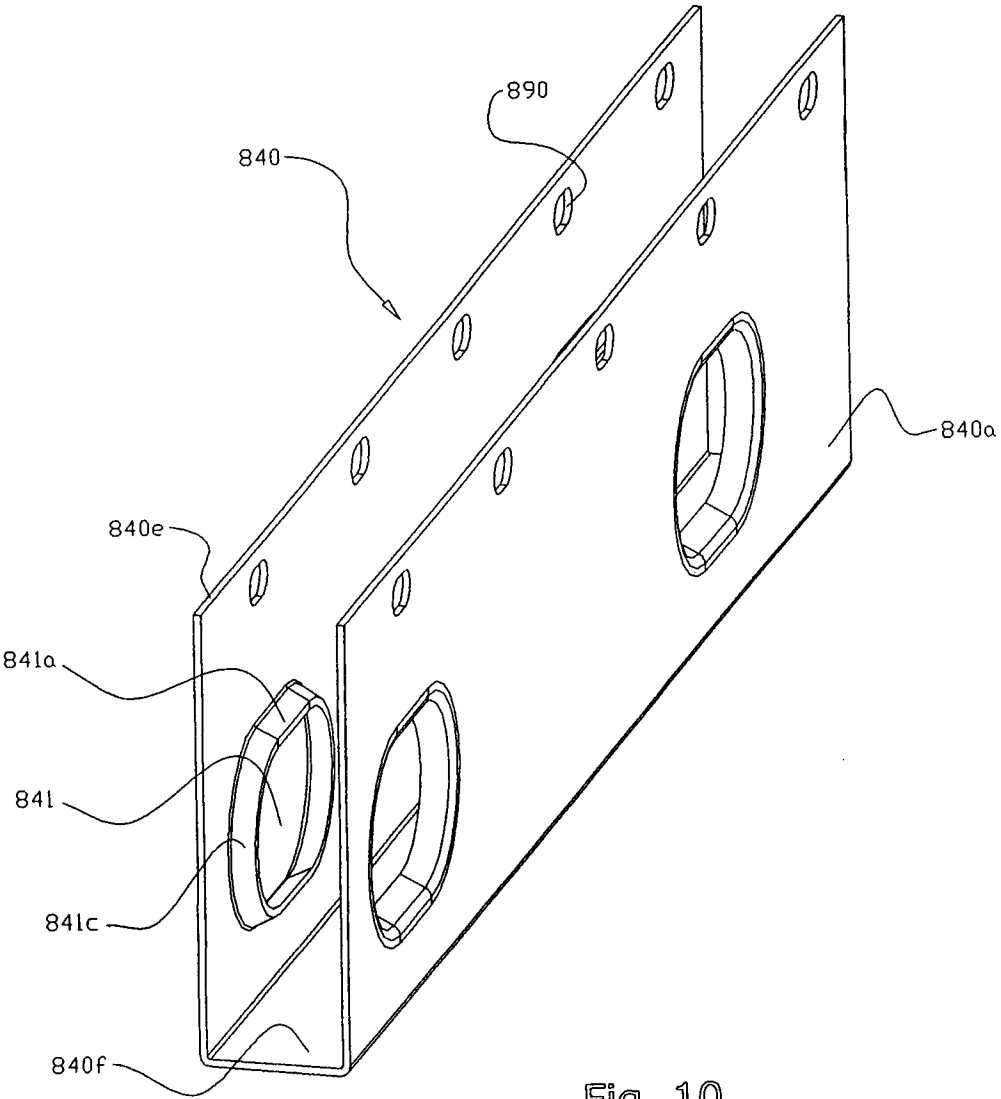
FIG. 10 is a top perspective view of part one of the U-shaped composite beam members used in the system of FIGS. 9*a* and 9*b*.

Finally, with reference to FIG. 10, a generally U-shaped, integrally formed beam member 840 is shown. Beam member 840 can be used, for example, instead of composite beam 780, in the system illustrated in FIGS. 9*a* and 9*b*. Beam 840 has a base web plate 840*f* from which are upstanding side webs 840*a*. Side webs have large central apertures 841 surrounded at their edges by inwardly directed flanges 841*c* having an upper surface 841*a*. Apertures 841 can be used in the same manner as described above, such as with apertures 141. Positioned below a top edge 840*e* of each side web 840*a* are a plurality of spaced apertures 890 which can be used to assist in anchoring the beam in a concrete slab.

Although the above embodiments have been described in connection with use with concrete, other similar construction materials which can be formed and harden in a construction form, can be used.

It is understood that the above-described embodiments are illustrative of only a few of the many possible specific embodiments of the invention. Numerous and varied other arrangements can be made by those skilled in the art without departing from the spirit and scope of the invention, as defined only by the claims herein.

The invention claimed is:

1. A formwork system for retaining load from a construction material having both unhardened and hardened states during fabrication of a floor or roof slab from said construction material, said system having components comprising:

a) a form panel unit comprising:

i. a panel member made from a foam plastic and adapted for use as part of said formwork system to retain said construction material when in an unhardened state, said panel member having an upper surface and a lower surface, said upper surface defining a shape of the lower surface of said slab, and said panel member having first and second opposed, transversely spaced, longitudinally extending side edges, said first and second side edges generally extending between a transversely extending front edge and a spaced transversely extending rear edge; said upper surface and said lower surface, said side edges, said front and rear edges of said panel member being configured for abutment with other components of said formwork system;

ii. a plurality of reinforcement units, each said reinforcement unit being oriented transversely to said side edges of said panel member and longitudinally spaced from said front and rear edges each reinforcement unit having a plurality of portions joined together as a composite structure; each said reinforcement unit comprising a first portion and a second portion interconnected with a third portion; said reinforcement unit being rigidly interconnected to said panel member, each said reinforcement unit contributing to internal reinforcing said panel member of said form panel unit and supporting said form panel unit, said first portion of each said reinforcement unit adapted for reinforcing said panel member at an intermediate position that is transversely and longitudinally located between and distant from said side edges and said front and rear edges respectively of said panel member; said first portion comprising a interconnected generally oriented vertical section and a generally oriented horizontal section; said generally oriented horizontal section of said first portion of said reinforcement unit comprising a generally horizontally, longitudinally and transversely extending and upwardly directed surface that supports said form panel unit at proximate said lower surface of said panel member;

said second portion of each said reinforcement unit adapted for supporting said form panel unit during fabrication of said floor or roof slab made from said construction material;

said form panel unit being capable of supporting said construction material above said panel member when in an unhardened state;

b) first and second spaced structural supporting members oriented generally longitudinally and adapted for assisting in supporting said form panel unit when fabricating said floor or roof slab with said construction material in said unhardened state;

said panel member being configured such that said form panel unit can be supported by each said reinforcement unit at least partially by said first and second structural supporting members, such that said unhardened construction material can be retained above said upper surface of said panel member to permit hardening of said construction material from said unhardened state to said hardened state, said reinforcement unit oriented generally transversely to said first and second structural supporting members such that said load to said panel member can be carried by said first portion of said reinforcement unit from said intermediate position and transferred to said second portion of said reinforcement unit, said second portion transfers said load to said first and second structural members carrying said load, said second portion of said reinforcement unit having first and second opposed support portions, said first and second support portions being mounted respectively on upwardly directed surfaces of said first and second structural supporting members such that said form panel unit is at least in part supported by said first and second structural supporting members wherein said first portion of said reinforcement unit of each of said plurality of reinforcement units comprises a connector and said third portion of said reinforcement unit comprises at least one vertical rod secured to said second portion and said connector, said vertical rod also being secured to said panel member with said connector, and wherein said connector reinforces said panel member and provides support to said form panel unit with said upwardly directed surface reinforcing said panel member.

2. A system as claimed in claim 1 wherein said second portion of each said reinforcement unit comprises a reinforcement member interconnected to said third portion such that said reinforcement member has a portion positioned above said upper surface of said panel member.

3. A system as claimed in claim 2 wherein said portion of said reinforcement member of said reinforcement unit positioned above said upper surface of said panel member is spaced apart from said upper surface of said panel member to reinforce said floor or roof slab when said construction material in a hardened state.

4. A system as claimed in claim 1 wherein said second portion of said reinforcement unit is positioned above and spaced from said upper surface of said panel member.

5. A system as claimed in claim 1 wherein said first and second support portions of said second portion of said reinforcement unit each comprises a lower surface for supporting said form panel unit during fabrication of said floor or roof slab made from said construction material, said lower surfaces of said first and second support portions of each said second portion of said reinforcement unit being visible when said form panel unit is viewed upwardly from the bottom of said lower surface of said panel member.

6. A system as claimed in claim 5 wherein said first and second support portions of said second portion of said reinforcement unit are supported directly upon upwardly directed surfaces of respectively said first and second structural supporting members.

7. A system as claimed in claim 1 wherein said second portion of each of said plurality of reinforcement units each comprises a plurality of reinforcement members; said third portions of each of said plurality of reinforcement units each comprises a plurality of vertical rods; each said vertical rod secured to at least one of said reinforcement members said vertical rods passing from said upper surface of said panel member toward said lower surface of said panel member and engaging a connector which provides said upwardly directed surface that assists in supporting said form panel unit when construction material in said unhardened state is retained above said panel member.

8. A system as claimed in claim 7 wherein said reinforcement member of each of said plurality of reinforcement units has a first and second extension portion; said second extension portion being opposite to said first extension portion one of said first and second end extension portions supported on one of said first and second structural supporting members, and the other of said first and second end extension portions supported on the other of said first and second structural supporting members, and wherein said form panel unit is suspended from said upwardly directed surface of said first and second structural supporting members and between said first and second structural supporting members, and wherein each of said first and second structural supporting members has an upper portion extending above said upper surface of said panel member so as to be embedded in said construction material when said construction material is in said hardened state.

9. A system as claimed in claim 8 wherein each said upper portion of said first and second structural supporting members is embedded in said construction material and generally configured as an upstanding elongated web portion linked with a horizontal flange having upper and lower transverse oriented surfaces and longitudinally oriented vertical surfaces embedded in said construction material when said construction material is in said hardened state.

10. A system as claimed in claim 9 wherein said reinforcement member has a first end portion, and a second end portion opposite to said first end portion, said first and second portions are each supported in part by a transverse surface of one of said first and second structural supporting members and said first and second end portions of said reinforcement member extend over each of said respective first and second structural supporting members; said vertical rods of each reinforcement unit having an upper portion located above said upper surface of said panel member; said upper portion and said first and second end portions configured to allow suspension of said form panel unit such that said upper surface of said panel member is positioned lower than said lower transverse surface of said horizontal flange of said upper portion of said structural supporting member.

11. A system as claimed in claim 7 further comprising each said reinforcement unit having a spacer member interconnected to said third portion and said second portion of said reinforcement unit and positioned above said upper surface of said panel member, whereby said panel member is compressed between each said connector and said spacer member.

12. A system as claimed in claim 1 wherein said panel member is made at least in part from a foam plastic having at least one laminated outer surface laminated with a plastic skin.

13. A system as claimed in claim 12 wherein said laminated outer surface is arranged to contact said construction material.

14. A system as claimed in claim 12 wherein said laminated surface is a polypropylene laminated surface.

15. A system as claimed in claim 3 wherein said first and second supporting members each comprises an elongated structural support member generally configured in an L-shape or U-shape, said structural support members for use in supporting said panel unit, each said support member having an upstanding web having an upper elongated web portion, said upper web portion having a plurality of spaced apertures disposed along said elongated upper web portion and being positioned so that hardened construction material will be received through said apertures to embed said first and second supporting members in said slab.

16. A system as claimed in claim 1 wherein said foam plastic is a foam polystyrene.

17. A system as claimed in claim 16 wherein said panel member is made from foam polystyrene is provided with a skin providing a greater flexural strength to said panel member.

18. A system as claimed in claim 17 wherein said skin is made from polypropylene or polyethylene.

19. A system as claimed in claim 1 wherein said construction material comprises concrete.

20. A formwork assembly as claimed in claim 1, wherein said second portion of said reinforcement unit comprises a rebar member.

21. A formwork system for retaining load from a construction material having both unhardened and hardened states during fabricating a floor or roof structure, said system having a plurality of components comprising:

a) a plurality of form panel units, each form panel unit comprising:

i. a panel member made from a foam plastic and adapted for use as part of a form, to retain above, and support said load associated with said construction material when in an unhardened state, said panel member having opposed upper and lower surfaces and opposed side surfaces; said upper, lower and side surfaces configured for abutment with other of said components of said formwork system; said lower surface of said panel member comprising substantially only said foam plastic of said panel member;

ii. at least one reinforcement unit having a plurality of components joined together as a composite structure, said reinforcement unit comprising at least one strengthening member being oriented generally in a first direction, said at least one reinforcement unit remaining as part of said floor or roof structure when said concrete is in a hardened state; said reinforcement unit said form panel unit with said at least one reinforcement unit being capable of supporting said construction material above said panel member when in an unhardened state;

b) at least one structural supporting member oriented in a second direction that is generally perpendicular to said first direction;

said form panel unit being supported at least partially by said at least one structural supporting member, such that said unhardened construction material can be retained and supported above said upper surface of said panel member to permit hardening of said construction material from said unhardened state to said hardened state, wherein at least a part of said load on said form panel unit is transferred to said strengthening member and wherein the strengthening member in turns transfers at least part of said load transversely to said at least one structural supporting member, such that said form panel unit is at least in part supported by said at least one structural supporting member;

and wherein said reinforcement unit further comprises a vertical member oriented generally vertically and generally orthogonal to both said first direction in which said strengthening member is oriented, and said second direction in which said at least one structural supporting member is oriented, said vertical member being connected to a connector, wherein said connector provides support to said form panel member at a lower surface of said panel member with an upwardly directed surface of said connector.

22. A system as claimed in claim 21 wherein said strengthening member is mounted in a position such that said strengthening member has a portion positioned above said upper surface of said panel member.

23. A system as claimed in claim 22 wherein at least one structural supporting member comprises first and second structural support members both oriented generally in said second direction that is generally orthogonal to said first direction, and both said first and second structural supporting members being adapted for assisting in supporting said form panel unit when fabricating said floor or roof from said construction material in said unhardened state and wherein each of said plurality of reinforcement members is supported at least in part by both of said first and second structural supporting members such that said form panel unit is at least in part supported by said first and second structural supporting members.

24. A system as claimed in claim 21 wherein said strengthening member is positioned and spaced from said upper surface of said panel member such that said strengthening member reinforces said floor or roof slab when said construction material is in said hardened state.

25. A system as claimed in claim 21 wherein said system comprises a plurality of reinforcement units each being generally transversely oriented and longitudinally spaced from each other and said plurality of reinforcement units being supported at least in part by said at least one structural supporting member such that said form panel unit is at least in part supported by said at least one structural supporting member.

26. A system as claimed in claim 21 wherein said foam plastic is a foamed polystyrene.

27. A system as claimed in claim 26 wherein said said panel member made from foam polystyrene is provided with a skin providing for greater flexural strength to said panel member.

28. A system as claimed in claim 27 wherein said skin is made from polypropylene or polyethylene.

29. An assembly as claimed in claim 21 wherein said strengthening member is also positioned to be enveloped by said construction material when said construction material is in said hardened state.

30. A formwork assembly for fabricating a floor or roof slab from a construction material, said construction material having both hardened and unhardened states, said assembly having a plurality of components comprising:

a) a plurality of panel units, each said panel unit comprising:

i. a panel member made from a foam plastic; said panel member having opposed upper and lower surfaces, opposed transversely spaced side surfaces and opposed longitudinally spaced front and rear surfaces; said panel member having at least one surface configured for abutment with at least one other of said components of said assembly;

at least one panel reinforcement unit having a plurality of portions joined together as a composite structure and having at least one transversely oriented panel support member integrated with said panel member for reinforcing said panel member of said panel unit, said panel support member having at least a portion that is embedded and extends within said panel member between proximate an upper surface of said panel member to and through the panel member to and through the lower surface of the panel member to provide support for and at the lower surface of the panel member to reinforce said panel member, said panel support member of said reinforcement unit strengthening only said panel member in which said portion is embedded and none other of said panel units of said plurality of panel units;

said panel unit and said at least one reinforcement unit being capable of supporting said construction material above said panel member when in an unhardened state;

b) at least one structural support member having interconnected longitudinally oriented upper and lower portions, said at least one structural support member adapted to support at least in part said panel unit during said fabrication of said floor or roof slab when said construction material is in an unhardened state;

said unhardened construction material positioned above said panel unit being supported at least in part by said transversely oriented panel support member, said transversely oriented panel support member being supported at least in part on said at least one structural supporting member, said construction material enveloping at least an upper portion of said at least one structural supporting member when said construction material is in said hardened state.

31. An assembly as claimed in claim 30 wherein said panel support member is also adapted to reinforce the concrete floor or roof slab and being enveloped by said construction material when said construction material is in said hardened state.

32. An assembly as claimed in claim 31 wherein said at least at least one structural support member has a pair of webs configured in a generally L or U-shaped configuration, each web having an upper elongated web portion, said upper web portions having a plurality of spaced apertures disposed along said elongated upper web portion, and being positioned so that construction material will be received through said apertures to anchor said at least one structural supporting member is said construction material.

33. An assembly as claimed in claim 31 wherein said at least at least one structural supporting member has an elongated upper portion interconnected with an elongated web portion, said upper portion embedded in said construction material and being generally configured as an upstanding elongated web portion linked with a horizontal flange, said flange having have upper and lower transverse oriented surfaces and longitudinally oriented vertical surfaces embedded in said construction material in said hardened state.

34. An assembly as claimed in claim 30 wherein said panel member is made from a foam plastic having at least one or said upper or lower surfaces laminated with a strength enhancing skin.

35. An assembly as claimed in claim 34 wherein said foam plastic is a foam polystyrene.

36. An assembly as claimed in claim 30 wherein said foam plastic is a foam polystyrene.

37. A system as claimed in claim 30 wherein said panel member has both an upper laminated surface and a lower laminated surface strengthening said panel member.

38. A system as claimed in claim 37 wherein said upper and lower laminated surfaces are polyethylene laminated surfaces.

39. A system as claimed in claim 30 wherein said at least one structural supporting member comprises first and second spaced structural supporting members and said system further comprises a plurality of generally longitudinally spaced and generally transversely oriented reinforcement units, and wherein each said reinforcement unit of said plurality of reinforcement units supports said form panel unit between first and second spaced structural supporting members, each said second portion of each said reinforcement unit of said plurality of reinforcement units comprises a first end portion mounted on one of said first and second structural supporting members and a second end portion mounted on the other of said first and second structural supporting members, whereby said panel member form panel unit can be supported by said first and second structural supporting members with said plurality of reinforcement units.

40. A formwork assembly for fabricating a floor or roof slab from a construction material, said construction material having both hardened and unhardened states, said assembly comprising a plurality of panel units:

a) each of said plurality of panel units comprising:

i. a panel member made from a foam plastic;

ii. at least one panel reinforcement unit having at least one panel support member integrated with only said panel member and no other panel members of any other panel units of said plurality of panel units, said reinforcement unit for reinforcing said panel member of said panel unit, said panel support member having at least a portion that is embedded and extends within said panel member between proximate an upper surface of said panel member to and through the panel member to and through the lower surface of the panel member to provide support for and at the lower surface of the panel member;

said panel unit being capable of supporting said construction material above said panel member when in an unhardened state;

b) at least one longitudinally oriented structural support member adapted to support at least in part said panel unit during said fabrication of said floor or roof slab when said construction material is in said unhardened state.

41. A formwork assembly for fabricating a floor and/or roof slab from a construction material, said construction material having both hardened and unhardened states, said assembly comprising:

a) a plurality of panel units, each of said plurality of panel units comprising:

i. a panel member made from a foam plastic;

ii. at least one panel reinforcement unit having at least one panel support member integrated with only said panel member and no other panel members of any other panel units of said plurality of panel units, said reinforcement unit for reinforcing said panel member of said panel unit, said panel support member having one or more portions, the one or more portions being embedded and extending within said panel member from proximate an upper surface of said panel member through a midpoint location between said upper and lower surfaces, to proximate a lower surface of the panel member to provide support of said panel member proximate the lower surface of said panel member during fabrication of said floor and/or roof slab from said construction material;

each of said plurality of panel units being capable of supporting said construction material above said panel member when in an unhardened state;

b) at least one longitudinally oriented structural support member adapted to support at least in part said panel units during said fabrication of said floor and/or roof slab when said construction material is in said unhardened state;

said panel units adapted to be supported at least in part by said at least one longitudinally oriented structural support member.

42. A formwork assembly as claimed in claim 41 wherein said at least one longitudinally oriented spaced structural support member comprises first and second longitudinally oriented spaced structural support members adapted to support at least in part said panel units during said fabrication of said floor and/or roof slab when said construction material is in said unhardened state.

43. A formwork system for fabricating a floor and/or roof slab from a construction material having both unhardened and hardened states, said system comprising a plurality of form panel units each of said plurality of form panel units being supported between first and second structural supporting members, wherein each of said plurality of form panel units comprises:

i. a panel member made from a foam plastic and being adapted to retain above said panel member said construction material in said unhardened state, said panel member having an upper surface and a lower surface spaced from said upper surface;

ii. at least one reinforcement unit adapted for providing support for said panel member between said first and second structural supporting members during said fabrication of said slab;

said at least one reinforcement unit comprising one or more reinforcement portions at least partially embedded within said panel member, said one or more reinforcement portions including a portion that extends generally horizontally and that is positioned proximate said lower surface of said panel member for supporting said panel member proximate said lower surface of said panel member;

said at least one reinforcement unit further comprising a first supporting portion being supported on said first structural supporting member and a second supporting portion being supported on said second structural supporting member;

said first and second supporting portions being positioned closer to said upper surface of said panel member than said lower surface of said panel member;

said one or more reinforcement portions and said first and second supporting portions being connected together;

said first and second structural supporting members being spaced and oriented generally longitudinally and being adapted for providing support for said plurality of form panel units when fabricating said floor or roof slab with said construction material in said unhardened state;

each of said plurality of form panel units in said system being configured to be at least in part supported by said first and second structural supporting members such that said unhardened construction material can be retained above said upper surface of said panel member to permit hardening of said construction material from said unhardened state to said hardened state.

44. A system as claimed in claim 43 wherein said first and second supporting portions of said reinforcement unit are positioned proximate said upper surface of said panel member.

45. A system as claimed in claim 44 wherein said panel member has first and second opposed, transversely spaced, longitudinally extending longitudinal side edges, said first and second longitudinal side edges generally extending between a transversely extending front transverse side edge and an opposed spaced and transversely extending rear transverse side edge.

46. A system as claimed in claim 45 wherein said first supporting portion of said reinforcement unit is positioned proximate said first longitudinal side edge of said panel member and supported on said first structural supporting member and said second supporting portion of said reinforcement unit is positioned proximate said second longitudinal side edge of said panel member and supported on said second structural supporting member.

47. A system as claimed in claim 45 wherein each said longitudinal side edge and transverse side edge of said plurality of form panel units is configured such that in operation, while being supported on said first and second structural supporting members, leakage of said unhardened construction material can be prevented.

48. A panel unit comprising:

(i) a panel member comprising a foam plastic and being adapted to retain above said panel member a construction material in an unhardened state, said panel member having an upper surface and a lower surface spaced from said upper surface;

(ii) at least one reinforcement unit interconnected to said panel member, said at least one reinforcement unit being adapted for providing support for said panel member between first and second structural supporting members during said fabrication of a floor and/or roof slab;

said at least one reinforcement unit comprising one or more reinforcement portions at least partially embedded within said panel member, said one or more reinforcement portions including a portion that extends generally horizontally and that is positioned proximate said lower surface of said panel member for supporting said panel member proximate said lower surface of said panel member;

said at least one reinforcement unit further comprising a first supporting portion operable for supporting said panel unit on said first structural supporting member and a second supporting portion operable for supporting said panel unit on said second structural supporting member; said first and second supporting portions being positioned closer to said upper surface of said panel member than said lower surface of said panel member; said one or more reinforcement portions and said first and second supporting portions being connected together;

said panel unit being configured to be at least in part supported by said first and second structural supporting members such that said unhardened construction material can be retained above said upper surface of said panel member to permit hardening of said construction material from said unhardened state to said hardened state.

49. A formwork system for use in fabricating a structural reinforced floor from a construction material having both unhardened and hardened states, said formwork system having a plurality of components comprising:

(a) form panel unit comprising:

i. a panel member made from a foam plastic and having an upper surface, a lower surface, opposed longitudinal side surfaces and opposed transverse front and rear side surfaces; said surfaces being configured for abutment with at least one other of said components of said formwork system; said panel member being adapted to be used as part of a form to retain said construction material in an unhardened state;

ii. at least one transversely oriented reinforcement unit for reinforcing said panel member, said reinforcement unit comprising a portion extending from proximate said upper surface of said panel member and passing through said panel member to and through said lower surface of said panel member to provide support for and at said lower surface of said panel member; said at least one reinforcement unit having at least one panel support member;

(b) a structural supporting member;

said panel support member of said reinforcement unit having a portion for engagement with a structural supporting member oriented generally transverse to said support member;

said panel unit being configured such that said form panel unit may be supported on at least one structural supporting member by said at least one panel support member, such that said unhardened construction material can be retained above said upper surface of said panel member and can be supported at least in part by said form panel unit;

and wherein said surfaces of said panel member of said form panel unit are configured so as to be capable of mounting said form panel unit on said structural supporting member by vertical movement downwards of said form panel unit relative to said structural supporting member.

50. A formwork system as claimed in claim 49 wherein a generally downwardly angled portion is located at a longitudinal side edge of said upper surface.

51. A system as claimed in claim 50 wherein said downwardly angled portion is oriented generally orthogonal to said generally transversely oriented reinforcement units.

52. A formwork system as claimed in claim 49 wherein said reinforcing portion comprises a connecting member at least partly positioned within the panel member and extending between the upper and lower surfaces of said panel member, and wherein said reinforcement unit also comprises a connector having a cap portion providing a surface which assists in supporting said form panel unit proximate said lower surface of said panel member.

53. A formwork system for use in fabricating a slab from a construction material having both unhardened and hardened states, said formwork system comprising:

(a) a form panel unit comprising:

i. a panel member made from a foam plastic material and having upper and lower surfaces, said panel member being adapted to be used as part of a form to retain said construction material above said upper surface in an unhardened state;

ii. at least one, generally transversely oriented reinforcement unit, said reinforcement unit for reinforcing said panel member and having at least one panel support member having a portion for engagement with a structural supporting member oriented generally transverse to said panel support member;

said reinforcement unit further comprising a reinforcing portion embedded in said panel member and extending from proximate said upper surface of said panel member to proximate said lower surface of said panel member to reinforce said panel member;

said form panel unit with said reinforcement unit being capable of supporting said construction material above said panel member when in an unhardened state;

(b) at least one structural supporting member;

said panel support member having a portion for engagement with said at least one structural supporting member oriented generally transverse to said panel support member;

said form panel unit being supported at least in part on said structural supporting member by said panel support member of said reinforcement unit oriented generally transversely to said structural supporting member, such that said unhardened construction material can be retained above said panel member and be supported at least in part by said form panel unit;

and wherein said reinforcement unit comprises at least one connecting member that extends from proximate said lower surface of said panel member toward said upper surface of said panel member and engages said reinforcing portion of said reinforcement unit which assists in supporting said form panel unit when unhardened construction material is retained above said panel member, said at least one connecting member being interconnected to said at least one panel member;

and wherein said reinforcement unit comprises an upper compression member positioned above said upper surface of said panel member, whereby said upper compression member and said connecting member are displaced towards each other such that said panel member is compressed by and between said connecting member and said upper compression member.

54. A formwork system as claimed in claim 53 wherein said foam plastic is a foam polystyrene.

55. A formwork system as claimed in claim 53 wherein said upper and lower surfaces are laminated with a strength enhancing skin.

56. A formwork system as claimed in claim 55 wherein said skin is made from polypropylene or polyethylene.

* * * * *